US008646740B1

(12) United States Patent
Nelson et al.

(10) Patent No.: US 8,646,740 B1
(45) Date of Patent: Feb. 11, 2014

(54) SILICONE COASTER

(75) Inventors: Ann Nelson, Thousand Oaks, CA (US); Joy Kovaleski, Los Angeles, CA (US)

(73) Assignee: Funzone, Inc., Los Angeles, CA (US)

( * ) Notice: Subject to any disclaimer, the term of this patent is extended or adjusted under 35 U.S.C. 154(b) by 30 days.

(21) Appl. No.: 13/280,712

(22) Filed: Oct. 25, 2011

Related U.S. Application Data

(60) Provisional application No. 61/406,486, filed on Oct. 25, 2010.

(51) Int. Cl.
*A47B 91/00* (2006.01)

(52) U.S. Cl.
USPC ..... 248/346.11; 215/393

(58) Field of Classification Search
USPC ..... 248/346.11, 346.01; 215/393, 394, 395; 40/324; 156/69
See application file for complete search history.

(56) References Cited

U.S. PATENT DOCUMENTS

| | | | | |
|---|---|---|---|---|
| 6,877,705 | B2 * | 4/2005 | Dauer | 248/346.11 |
| 2011/0290976 | A1 * | 12/2011 | Kraus, Jr. | 248/346.11 |
| 2011/0297639 | A1 * | 12/2011 | Sorren-Norness et al. | 215/393 |

* cited by examiner

*Primary Examiner* — Todd M. Epps
(74) *Attorney, Agent, or Firm* — Aka Chan LLP

(57) ABSTRACT

A silicone coaster has an opening into which a base of a wine glass or other stemware can be slid into a sleeve or pocket of the coaster. This sleeve holds the coaster to the glass. When the glass is lifted, the silicone coaster also lifts with the glass. The coaster can be made using solid and liquid silicone. Liquid silicone can be vulcanized onto a solid silicone layer. The liquid silicone layers can be placed on the solid silicone in any desired design, including text, and in multiple vibrant colors.

18 Claims, 27 Drawing Sheets

SILICONE COASTER

CROSS-REFERENCE TO RELATED APPLICATIONS

This patent application claims the benefit of U.S. provisional application 61/406,486, filed Oct. 25, 2010, which is incorporated by reference along with all other references cited in this application.

BACKGROUND OF THE INVENTION

This invention relates to a silicone coaster and a process of making such a silicone coaster and, more specifically, to a multilayered (with a sleeve or pocket formed between the layers) or multicolored silicone coaster and its manufacture.

Consumers are increasingly looking for products that combine function and durability with unique design. Coasters are functional home and bar accessories that protect tops and tables against water damage from cups, wine glasses, mugs, or other objects that hold liquid.

Coasters made of inexpensive material such as paper or cardboard and are often thrown away after one or more uses. As these disposable coasters degrade, they may leave particles on surfaces, which have to be cleaned. This also adds to landfills and garbage. Glass coasters easily chip and can shatter. Stainless steel or metallic coasters can be scratched and bent easily. Those that are not thrown away can typically stain easily, making them look unsightly.

Further, a coaster can be easily pushed or slid on a surface. Drinks can easily spill despite being on top of the coaster.

Therefore, there is a need for improved coasters.

BRIEF SUMMARY OF THE INVENTION

A silicone coaster has an opening into which a base of a wine glass or other stemware can be slid into a sleeve or pocket of the coaster. This sleeve holds the coaster to the glass. When the glass is lifted, the silicone coaster also lifts with the glass. The coaster can be made using solid and liquid silicone. Liquid silicone can be vulcanized onto a solid silicone layer. The liquid silicone layers can be placed on the solid silicone in any desired design, including text, and in multiple vibrant colors.

Silicone coasters can have any number of vibrant colors without the use of paint (as compared to the coloration of typical sandstone and metallic coasters). The coaster can have intricate multicolor and multilevel design detailing. The coaster allows people to mark their glasses by color. The coaster can have a tacky or nonskid surface. The coaster fits stemware and is easily attached and unattached from the stemware. In a coaster, the use of paint is potentially dangerous because the paint may contain lead, mercury, or toxic substances.

A coaster can be made according to the process as described in this patent. The coaster will be 100 percent silicone. The coaster does not include paint. The coaster can be of any color and there can be additional artwork of multiple vibrant colors. The coloration of the coaster will not stain or fade over time. The coaster can be easily washed. The coaster will be odorless. The coaster can be made of various sizes to accommodate different cup or wine glass sizes. The coaster can have seasonal and licensed interpretations.

The silicone coaster can be easily cleaned, such as by immersing the coaster in a pot of boiling water for a few minutes. The coaster will easily withstand 100 degrees Celsius and even high temperatures without damage.

The silicone coaster can also help differentiate glasses they are used with. For example, at large parties, there may be many people enjoying red wine. However, it is often difficult to tell which glass belongs to which guest, particularly when the glasses at events are usually the same type of glass and guests often put down and pick up their drinks from different places. The silicone coasters have designs and colors that make it easy for guests to recognize their drinks.

In an implementation, a method includes providing a first layer having a first shape, where the first layer includes silicone; providing a second layer having the first shape, where the second layer also includes silicone; forming an opening having a second shape within an edge of the second layer; and connecting the second layer on the first layer along edges of the first and second layers, but allowing the forming of a pocket or sleeve between the first and second layers and the pocket is accessible via the opening.

In an implementation, a method of making a silicone coaster includes: mixing liquid silicone with first silicone color paste to obtain a colored liquid silicone; loading syringes with the colored liquid silicone; inserting the colored liquid silicone in cavities of a mold according to a pattern; heating to set the liquid silicone; mixing solid silicone with second silicone color paste to obtain a first colored solid silicone; layering the first colored solid silicone material into the mold on top of the liquid silicone; vulcanizing (or fusing) the solid and liquid silicone together, where the vulcanizing includes closing the mold; cooling the solid and liquid silicone; trimming a silicone flashing (optional); cutting an opening in the first solid silicone; and vulcanizing the first solid silicone with vulcanized liquid silicone onto a second solid silicone layer, where a pocket (or sleeve) is formed between the first and second layers and the pocket is accessible via the opening in the first solid silicone.

In an implementation, a kit includes a first silicone coaster including two silicone layers joined around along an edging of the layers, where between the layers is a unjoined region forming a pocket (or sleeve), which is accessible through an first opening formed in a first silicone layer of the two silicone layers, and a first colored ornamentation is applied to the first layer. The kit includes a second silicone coaster including two silicone layers joined around along an edging of the layers, where between the layers is a unjoined region forming a pocket, which is accessible through an second opening formed in a second silicone layer of the two silicone layers, and a second colored ornamentation is applied to the second layer, where the second colored ornamentation is different from the first colored ornamentation.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
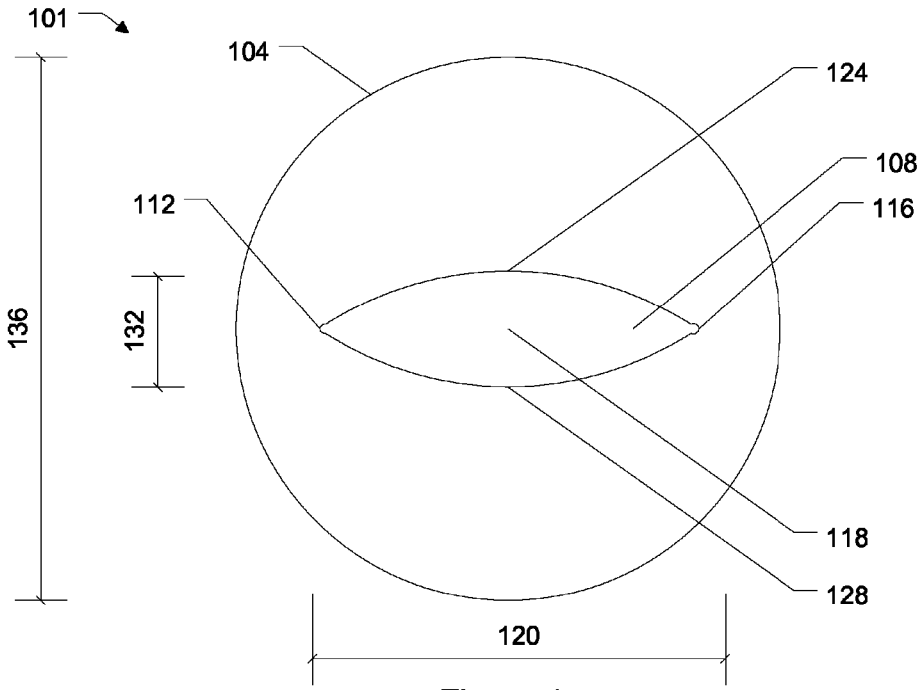
FIG. 1 shows a front view of a specific implementation of a silicone coaster.
Figure 2:
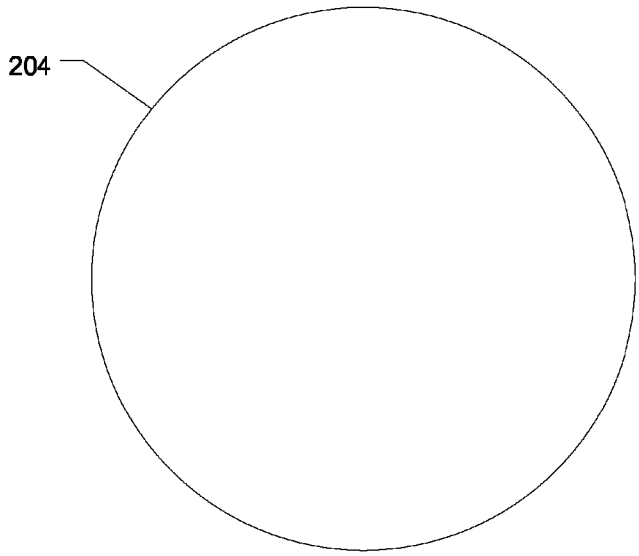
FIG. 2 shows a back view of the silicone coaster.

FIG. 1 shows a front view of a specific implementation of a silicone coaster 101. FIG. 2 shows a back view of the silicone coaster. In FIG. 1, a front 104 of a coaster includes a slit opening 108 and a first end opening 112 at a first end and a second end opening 116 at a second end. The openings can also be referred to as an aperture, break, crack, mouth, hole, or perforation. The coaster has a pocket or sleeve 118 that can be used to hold or store an object.

Between the first end opening and the second end opening is a length 120 (e.g., longer side). Between a midpoint of length 120 on a first side 124 of the slit opening and a midpoint of length 120 on a second side 128 of the slit opening is a width 132 (e.g., shorter side). The coaster has a diameter 136.

FIG. 2 shows a back view 204 of the silicone coaster having no ornamentation objects. The back of the coaster can rest upon a surface (e.g., table tops or desk tops) and is made of a material such that the coaster does not easily slide on the surface onto which it is placed. The back of the coaster can grip onto the surface and has a nonskid surface. The back of the coaster can also have a textured surface, which helps prevent slipping.

Figure 3A:
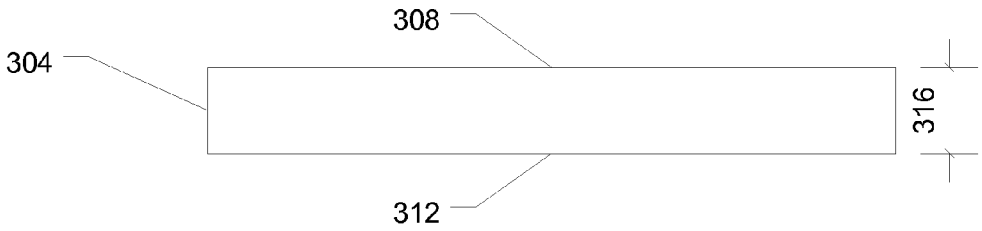
FIG. 3A shows a side view of the silicone coaster.
Figure 3B:
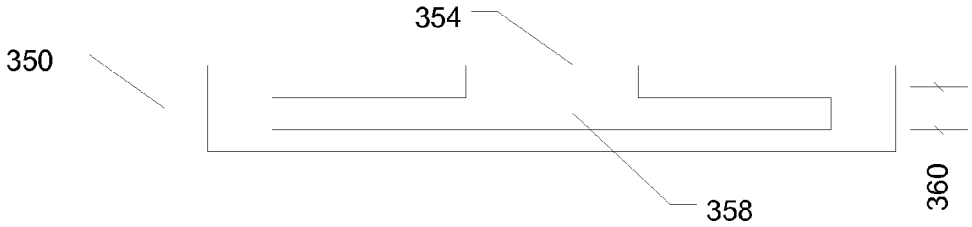
FIG. 3B shows a cross-sectional view of a silicone coaster having an opening and a pocket.

FIG. 3A shows a side view 304 of the silicone coaster. Between a first or top side 308 and a second or bottom side 312 of the coaster is a thickness 316. FIG. 3B shows a cross-sectional view of a silicone coaster 350 having an opening 354 and a sleeve (e.g., pocket or compartment) 358. The height of the pocket is 360.

In an implementation, the silicone coaster is a single piece of silicone material having the opening and sleeve. The sleeve is slit that is cut into the single silicone piece. In another implementation, the silicone coaster has at least two pieces attached or connected together. When the two pieces are attached, the sleeve is formed between the two pieces, upper and lower pieces. The upper and lower pieces are joined (e.g., fused or glued) along the edging to keep them attached.

The sleeve of the coaster can be used to hold the coaster to a glass. The base of a wine glass can be inserted through opening 354 into sleeve 358. Other types of glasses having bases can also be used with the coaster including a white wine glass, red wine glass, champagne flute, cocktail glass, martini glass, and hurricane glass. When the glass is inserted through opening 354, the sleeve of the coaster grips the base of the glass, on either side of the glass stem, to hold the coaster and glass together. The stem of the glass sticks out of the opening. When a person lifts the glass to drink from it, the coaster will also lift with the glass.

In an implementation, the at least two pieces of the silicone coaster are not of a uniform thickness. For example, the top (or upper) layer piece of silicone can be thicker at its outer edge, and gradually decrease in thickness as it nears the opening. Since the base of many wine glasses are thickest nearest its center (e.g., near the stem of the glass), this allows the coaster to tightly conform with the shape of the base of the glass and decrease chances that the coaster will accidentally become lose.

In another implementation, the two pieces of silicone coaster are not the same thickness. The upper layer can be thicker than the lower layer, or vice versa. This can offer savings in production costs (e.g., use of less material).

The coaster can be used to give the glass more stability, and also can be used to help cushion a glass base to prevent chipping or cracking when the glass is used on hard or rough surfaces (e.g., concrete or tile near a swimming pool). Since the coaster holds to the glass, this coaster can be used as a marker (e.g., drink or wine glass marker, wine glass charm, wine glass identification (ID) marker or tag, wine glass name tag, or other wine glass tag) for wine or spirits, such as for wine tastings and competitions. Therefore, this coaster can be used as a wine glass marker too, and a separate coaster and wine glass marker need not be used.

Figure 4:
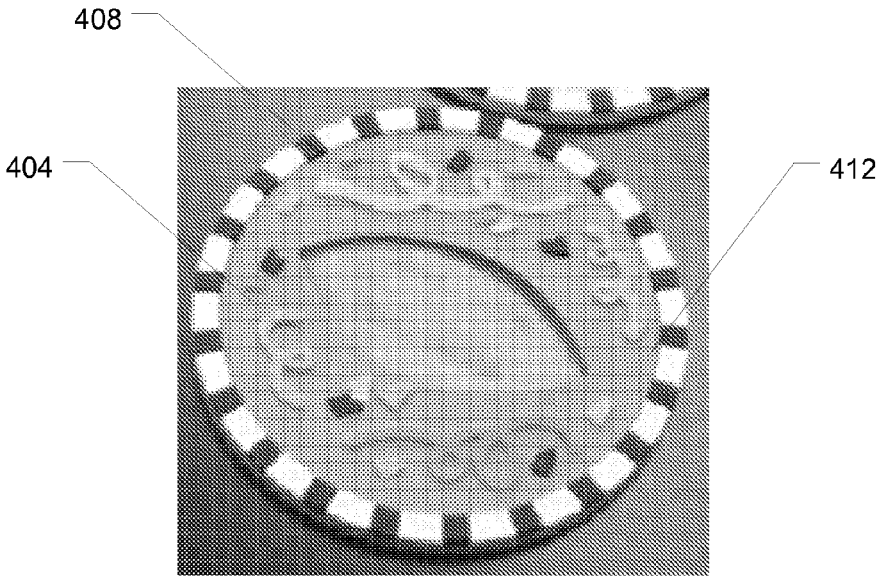
FIG. 4 shows a perspective view of the silicone coaster.

FIG. 4 shows a perspective view 404 of the silicone coaster.

In an implementation, the base is made of solid silicone (e.g., 100 percent silicone). Silicones are a polymer that generally contain silicon dioxide, carbon, hydrogen, and oxygen. Other elements can be included for specialized purposes to the polymer. In an implementation, a length 120 of the slit opening is about 7 centimeters and a width 132 of the slit opening is about 3.5 centimeters. Width 132 is about ½ of length 120. A diameter of the coaster is about 11 centimeters. In an implementation, a left side of first end opening 112 extends the slit opening about 1 centimeter, a right side of second end opening 116 extends the slit opening about 1 centimeter. A first or top edge of the slit opening is about 8.5 centimeters and a second or bottom edge of the slit opening is about 8.5 centimeters. In another implementation, the coaster is made with less than 100 percent silicone. For example, the coaster can be made with 90, 80, 75, 65, 50, or 40 percent silicone. The silicone can be replaced with a variety of other materials. This may reduce the manufacturing costs of the coaster. For example, other polymers can be used (e.g., synthetic rubber, latex polymer, polyester urethane, or others).

In an implementation, a shortest distance from a left side edge of the coaster to first end opening 112 is about 2 centimeters. A shortest distance from a right side edge of the coaster to second end opening 116 is about 2 centimeters. A shortest distance from a top edge of the coaster to the top edge of the slit opening is about 3.75 centimeters. A shortest distance from a bottom edge of the coaster to the bottom edge of the slit opening is about 3.75 centimeters.

These dimensions may vary depending on a variety of factors such as a size of the coaster, the slit opening, sides of the slit opening, and location of the slit opening.

In an implementation, thickness 316 is about 0.4 centimeters. A thickness of the coaster can vary and can be less than or greater than 0.4 centimeters. For example, in another implementation, the thickness of the coaster is about 0.20 centimeters, 0.275 centimeters, 0.325 centimeters, 0.45 centimeters, 0.50 centimeters, 0.575 centimeters, or greater.

Figure 5:
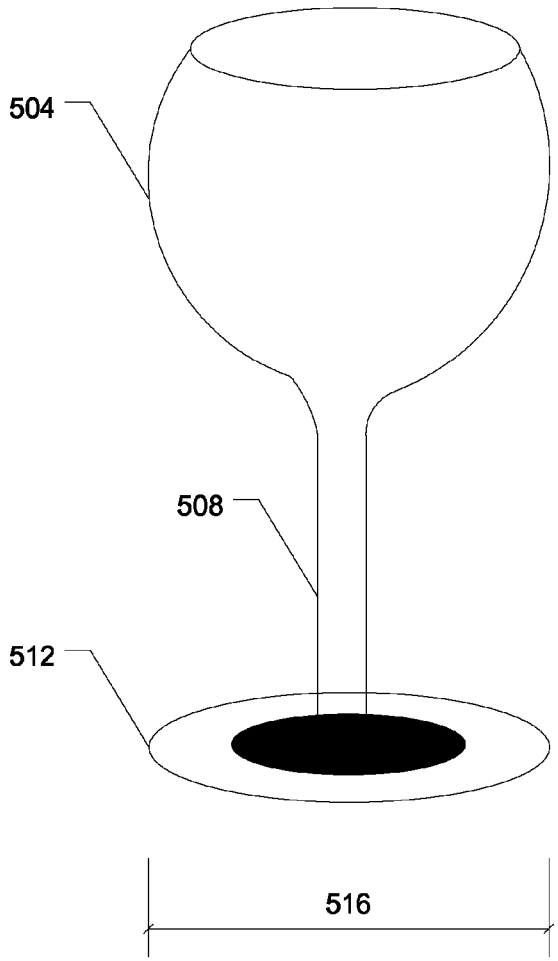
FIG. 5 shows a representative wine glass having a bowl, a stem, and a base.

FIG. 5 shows a representative wine glass having a bowl 504, a stem 508, and base (or foot) 512. The base has a diameter 516. A base of the wine glass can be inserted into a slit opening of the coaster. A front of the coaster is made of an elastic or stretchy silicone such that a user can pull or stretch sides of the slit opening to insert an object (e.g., base of a wine glass). This allows length 120 of the slit opening to be less than the diameter of the base of the wine glass. This also allows width 132 of the slit opening to be less than the diameter of the base of the wine glass.

Figure 6:
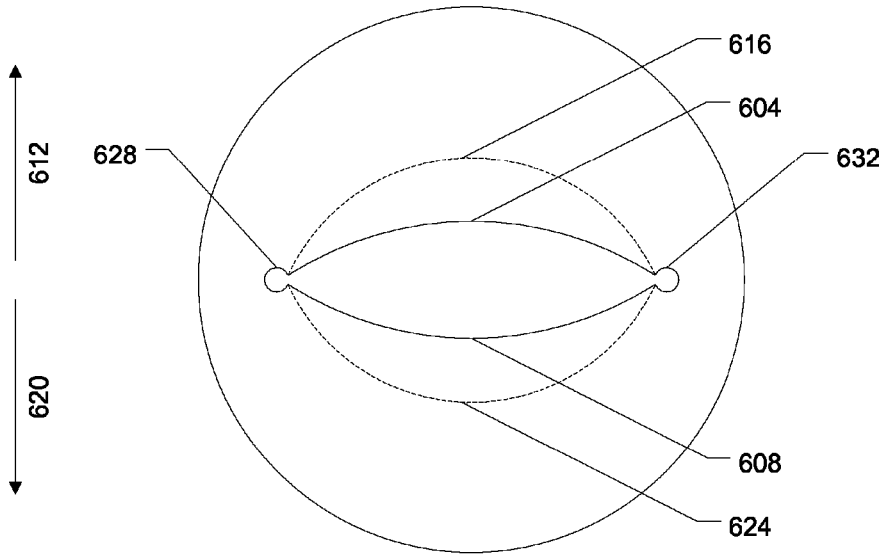
FIG. 6 shows a coaster having two slit side openings.

FIG. 6 shows a coaster having a first slit side opening 604 and a second slit side opening 608. The first slit side opening can be pulled in a first direction 612 such that a shape or position of the first slit opening is different from its initial position. First slit side opening 604 can be pulled to a location 616. A user can pull the first slit side opening in the first direction to more easily fit a base of a wine glass into the coaster.

The second slit side opening can be pulled in a second direction 620 such that a shape or position of the second slit opening is different from its initial position. Second slit side opening 608 can be pulled to a location 624. A user can pull the second slit side opening in the second direction to more easily fit a base of a wine glass into the coaster. The first direction is substantially opposite the second direction.

Wine glasses with bases of different sizes and shapes can easily fit into the coaster. The wine glass can easily be inserted and removed from the coaster. Further, when the slit side openings are pulled in another direction, a first end opening 628 and a second end opening 632 assist in preventing tears in the coaster. First and second openings 628 and 632 are rounded or circular, so that slit opening 118 does not have sharp edges or points where tearing can start.

Figure 7:
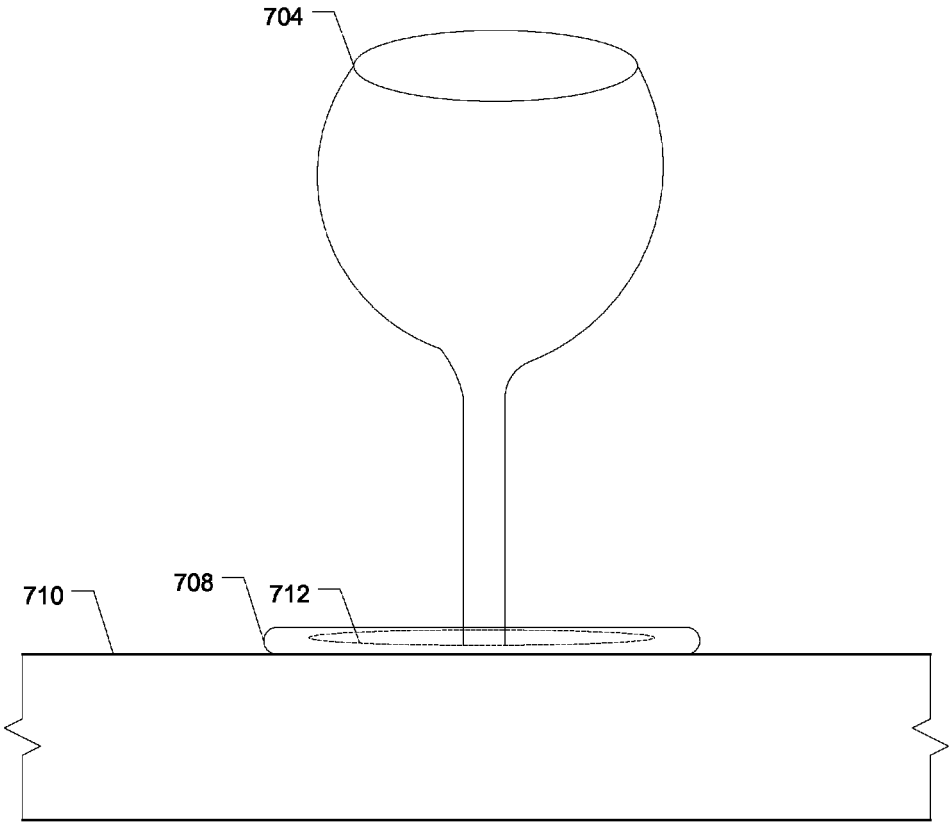
FIG. 7 shows a side view of a wine glass and a coaster resting on top of a surface.
Figure 8:
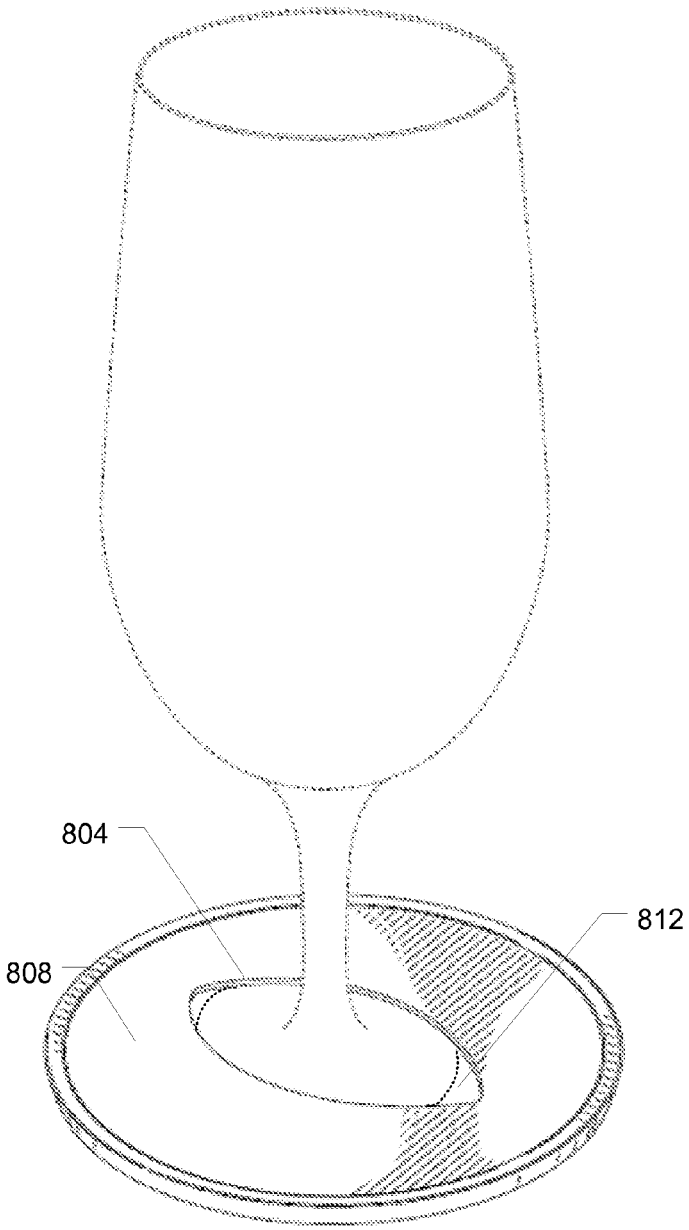
FIG. 8 shows a perspective view of a base of a wine glass and a coaster.

FIG. 7 shows a side view of a wine glass 704 and a coaster 708 resting on top of a surface 710. A base of the wine glass is inserted into the coaster through the slit opening. A base 712 of the wine glass is in broken lines. FIG. 8 shows a perspective view of a base 804 of a wine glass and a coaster 808. A diameter of the wine glass base is smaller than a diameter of the coaster, so an inside part of the pocket 812 can be seen. In another implementation, the lower layer is hidden by the base of the glass, but may still be visible if the glass is transparent.

The drinking vessel has been described as being a wine glass. For purposes of discussion, this patent describes the coaster as being for a wine glass. This is not intended to limit the invention. The coaster can be used with any type of drinking vessels. For example, in other implementations, the coaster is used for a martini glass and other stemware. The coaster may also used with drinking vessels without bases or stems, such as a tumbler, highball, collins, beer mug or mug, shot, cup, pitcher, bottle, and others. However, these types of glasses are placed on top of the coaster, and no base is inserted into the sleeve. The coaster can also be used for other types of vessels or containers including flower pots, candle holders, bowls (e.g., holding soup), and the like.

In an implementation, the base of the coaster is made of solid silicone. In an implementation, the silicone is a food grade silicone that is safe for use with foods. The silicone base can be made of any color by using a silicone colorant in the silicone base material. The silicone base can have a vibrant color without painting the surface of the silicone. Artwork or other ornamentation can be applied to the silicone base by applying colored layers. For a solid silicone base, liquid silicone of different colors (using a silicone colorant) can be layered onto the silicone base. U.S. patent application Ser. No. 12/953,457, filed Nov. 23, 2010, describes a technique of using solid and liquid silicones, and is incorporated by reference.

Figure 9:
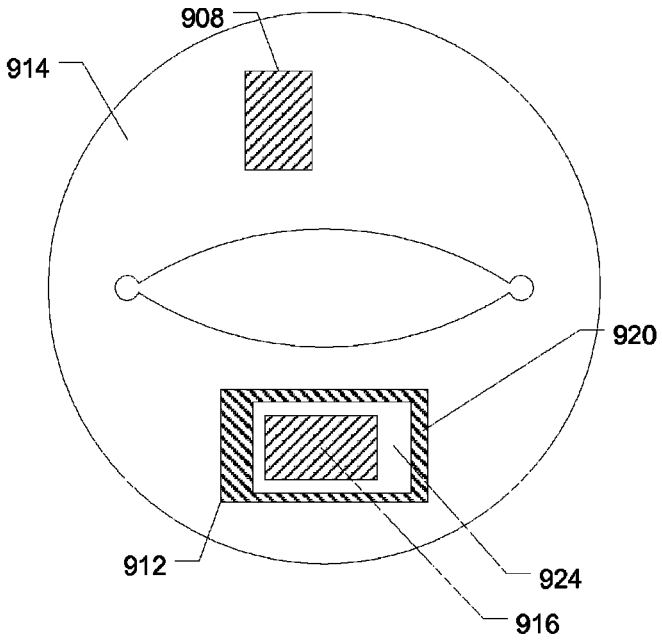
FIG. 9 shows a front of a coaster having two types of ornamentation objects.

FIG. 9 shows a front of a coaster having two types of ornamentation objects, a first object 908, and a second object 912. The first and second objects are formed on a surface of a base 914. First object 908 has a single layer of one color, which can be formed by using liquid silicone having a single silicone colorant. The color of the first object can be the same color as the base. A single layer can be used to create a raised texture or other surface patterning (see discussion below for FIG. 13) for the coaster. For example, numerous dots or other features can be formed on the surface as interesting textures. Alternatively, the color of the single layer can be different from the base or may have a different hue or shade from the base. This can be useful for making the first object become more visible with respect to the base background color.

Figure 10:
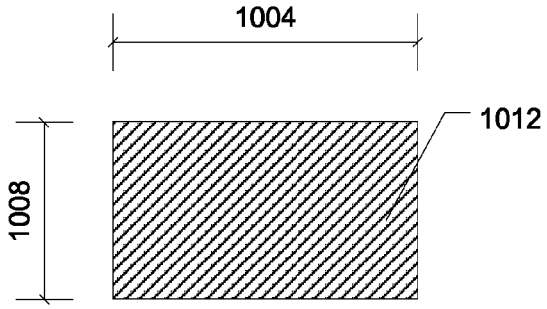
FIG. 10 shows a closer view of the first feature of the second object.
Figure 11:
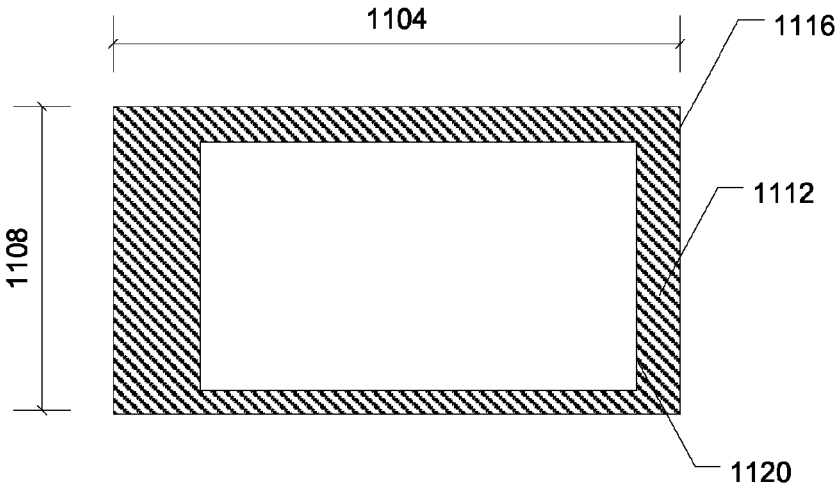
FIG. 11 shows a closer view of the second feature of the second object.

The second object has a first feature 916 and a second feature 920. In an implementation, these multiple layers are each made using liquid silicone having a single silicone colorant, and can be the same or a different color relative to each other, or have a different hue or shade relative to each other. For example, in an implementation, first feature 916 is light green, second feature 920 is dark green, and the base is bright blue. In another implementation, first and second features 916 and 920 are light yellow and the base is purple. Between an outer outline of the first feature and an inner outline of the second feature FIGS. 10-11 show a more detailed view of the second ornamentation object. FIG. 10 shows a closer view of the first feature of the second object. FIG. 11 shows a closer view of the second feature of the second object. In FIG. 10, the first feature is a rectangle and has a rectangular-shaped outline. The first feature has a length 1004 (e.g., longest side), a width 1008 (e.g., shortest side), and an area 1012.

In FIG. 11, the second feature has a length 1104 (e.g., longest side), a width 1108 (e.g., shortest side), and an area 1112. Area 1112 is less than the product of length 1104 and width 1108. The second feature has an outer outline 1116 having a rectangular shape and an inner outline or cutout 1120 having a rectangular shape. The first feature can be positioned within the cutout. In this implementation, the shape of the cutout in the second feature is a similar shape as the outer outline of the first feature.

In FIG. 11, the second feature has a rectangular-shaped outer outline and cutout. The shapes of the outer outline and cutout can be any shape. The shapes of the outer outline and cutout can be the same, similar, or different from each other. For example, in an implementation, a feature has a circular-shaped outer outline and a heart-shaped cutout. In this implementation, a heart-shaped shape can be positioned in the heart-shaped cutout. In another implementation, a feature has a triangular-shaped cutout, and a circular-shaped shape is positioned in the triangular-shaped cutout.

Referring back to FIG. 9, first feature 916 is located within the rectangular-shaped cutout of the second feature such that the cutout borders or frames first feature 916. Between the outline of first feature 916 and the inner outline of the cutout of second feature 920 is a space 924 in which the base surface is visible. When the base surface is visible, this creates a more colorful display on the coaster.

In another implementation, a cutout of second feature 920 borders a perimeter of first feature 912 such that the base is not visible between the cutout and first feature 916.

The base can include one or more of the object types shown and described in this application in any combination. For example, the base can have multiple first objects 908. The base can have a first object 908 and multiple second objects 912. The base can have only second objects 912 and no first objects 908.

The object types can be positioned anywhere as desired on the base, back or front, left or right, top or bottom, or above or below. For example, the first object can be to the right of the second object. The second object can be above the first object. Further, the objects can have lettering "Wine!" in a bright yellow color on a purple-colored base. Some other examples of lettering include "Party!," "Happy New Year," or "Tea Time!"

The heights and thicknesses of the objects can vary as desired. As explained above, each of the ornamentation objects is a layer formed on the base surface and forms a raised patterning.

Figure 12:
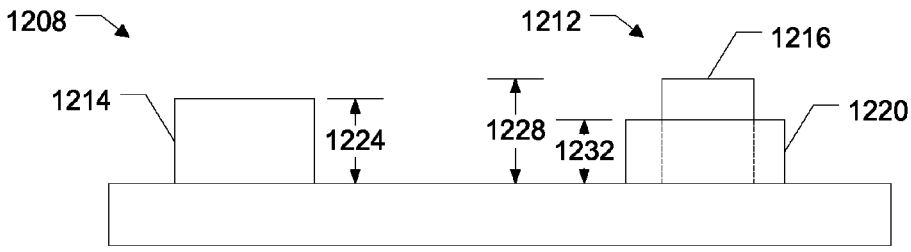
FIG. 12 shows a side view of the coaster with varying heights for the different layers.

FIG. 12 shows a side view of the coaster with varying heights for the different layers. Objects 1208 and 1212 are a layer formed on the base surface and form a raised patterning. Object 1208 has a feature 1214, and object 1212 has features 1216 and 1220. Feature 1214 of object 1208 and features 1216 and 1220 of object 1212 have a height above the base surface. Feature 1214 of object 1208 has a height 1224 above the base surface. Feature 1216 of object 1212 has a height 1228 above the base surface. Feature 1220 of object 1212 has a height 1232 above the base surface.

Height 1224 of feature 1214 is greater than height 1232 of feature 1220 and is less than height 1228 of feature 1216. Height 1232 of feature 1220 is less than height 1228 of feature 1216. The heights of the features above the base surface may be the same or different relative to each other. In a specific implementation, the heights range from 0 millimeters to about 8 millimeters. For example, the height of the feature or layer above the base may be about 0.15, 0.20, 0.5 millimeters, 0.75 millimeters, 0-1 millimeters, 1 millimeter, 1.2 millimeters, 1-2 millimeters, 2 millimeters, 3 millimeters, 2-3 millimeters, 4 millimeters, 5 millimeters, 6 millimeters, or 8 millimeters. In other implementations, the feature may be greater than 8 millimeters, such as 8.1, 8.5, or over 9 millimeters. In another implementation, there are three or more different heights for features of the coaster.

The heights also give a three-dimensional effect to the coaster. The different heights give a texture patterning on the top, and give the coaster a pleasant look and tactile feel. When a user touches the coaster, the user will have a firm grip on the silicone coaster.

Figure 13:
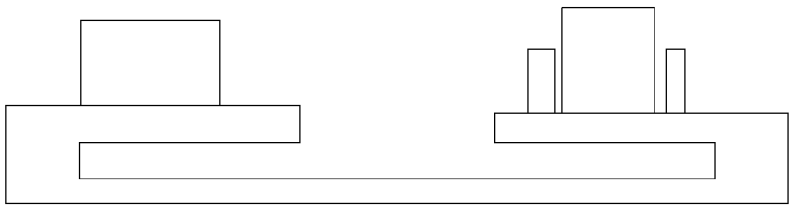
FIG. 13 shows a cross-sectional view of the silicone coaster.

FIG. 13 shows a cross-sectional view of the silicone coaster. As shown, each of the objects is formed directly on the silicone base. This patent describes forming objects directly on the base. However, the principles of the invention can be extended so that after a first pattern if formed on the base, additional layers and patterns can be formed on the first pattern, rather than the silicone base itself.

In FIG. 9, object 908 is shown as a rectangle but can be any artwork including any shape (e.g., polygons (open or closed), circles, squares, triangles, trapezoids, or octagons), lettering, text, graphics, or pictures (e.g., a house, tree, or roller skate). Ornamentation can take any artwork form.

Further by having different designs on the coasters, a user can distinguish his or her wine glass from other wine glasses. This will create a more comfortable party environment. The coaster is a portable coaster that allows party-goers to mark their glasses by color.

Figure 14:
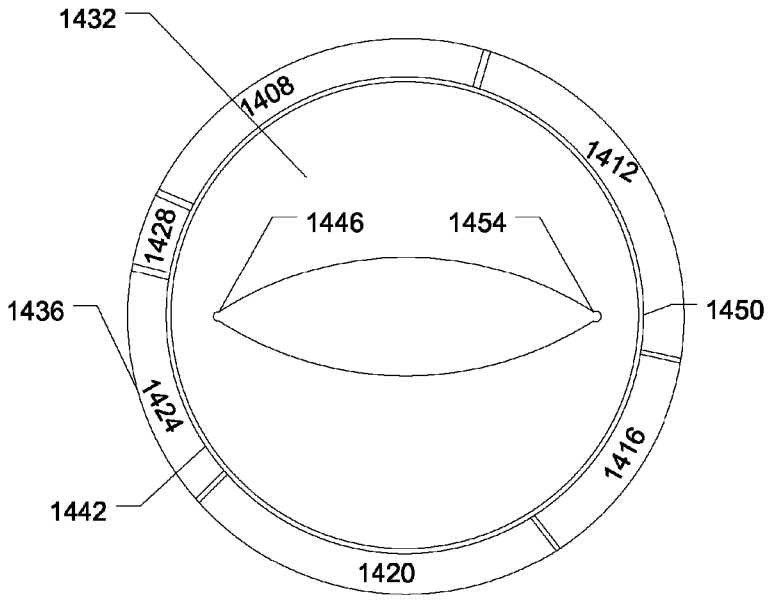
FIG. 14 shows a front view of a specific implementation of a coaster.

FIG. 14 shows a front view of a specific implementation of a coaster. An outer rim of the coaster is decorated with ornamentation objects 1408, 1412, 1416, 1420, 1424, and 1428. The ornamentation objects can be the same color, different colors, same hue, different hue, same shade, or different shade relative to each other and the base color or colors. Between ornamentation objects 1408 and 1412 is space in which a side of the coaster is visible. Between ornamentation objects 1412 and 1416 is space in which a side of the coaster is visible. Between ornamentation objects 1416 and 1420 is space in which a side of the coaster is visible. Between ornamentation objects 1420 and 1424 is space in which a side of the coaster is visible. Between ornamentation objects 1424 and 1428 is space in which a side of the coaster is visible. Between ornamentation objects 1428 and 1408 is space in which a side of the coaster is visible.

In another implementation, there is no space between the objects. In an implementation, some objects have space between them and other objects do not have space between them.

The coaster also has a silicone top side 1432. In an implementation, between an outer rim of silicone top side 1432 and an object is space. In an implementation, there is no space between an outer rim of silicone top side 1432 and the objects.

In an implementation a shortest distance between a side edge 1436 and a side edge 1442 is about 0.5 centimeters. A diameter of silicone top side 1432 is 9.75 centimeters. A shortest distance between side edge 1442 and a left side opening 1446 of a slit opening is 1.5 centimeters. A shortest distance between a side edge 1450 and a right side opening 1454 of a slit opening is 1.5 centimeters.

Figure 15:
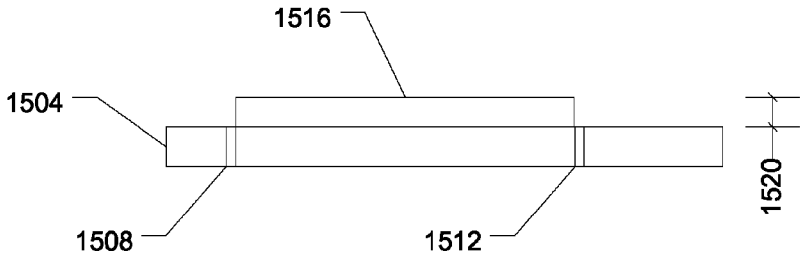
FIG. 15 shows a side view of the coaster having markings.

FIG. 15 shows a side view 1504 of the coaster having markings 1508 and 1512. An ornamentation object 1516 has a height 1520 above the base surface. In an implementation, height 1520 is 0.2 centimeters.

The front and back can have the same or different ornamentation. The coaster can have different artwork on the front and back sides. For example, the front may have an intricate multicolored scatter pattern on the front side, and a message in text on the back side.

Further, there can be a different number of colors or layers on the front side as compared to the back side. For example, the front side may have two or more different colors (both different from the base) while the back side may have only one color (different from the base). In another example, the front side has two or more different colors (both different from the base) and the back side has two or more different colors (both different from the base). Both front and back sides can be multicolored, but the surface ornamentation or shapes on the two sides can be different. For example, the front may have multilayered or multicolored circles while the back has multilayered or multicolored squares.

As shown in FIG. 7, a back of the coaster rests on top of a surface. The back of the coaster can also have ornamentation objects. In an implementation, objects on a back of a coaster will be symmetrical such that the coaster can be evenly placed on a surface. This prevents a drink in the coaster from easily tipping over.

Figure 16:
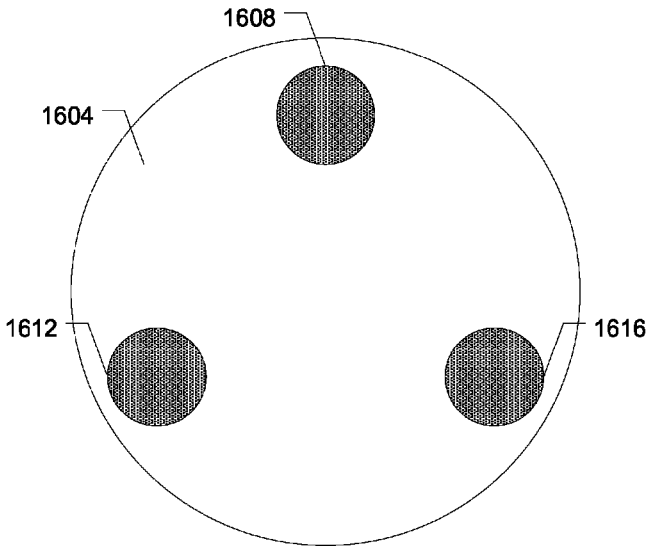
FIG. 16 shows a specific implementation of a back of a coaster having three ornamentation objects.

FIG. 16 shows a specific implementation of a back 1604 of a coaster having three ornamentation objects. This implementation has objects 1608, 1612, and 1616 of a single layer (similar to object 908 described above) attached to the base surface. In an implementation, objects 1608, 1612, and 1616 have a single color. In another implementation, objects 1608, 1612, and 1616 have different colors or hues with respect to each other.

Figure 17:
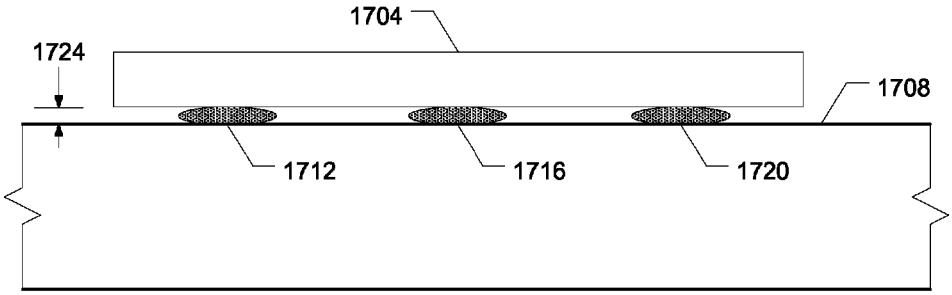
FIG. 17 shows a side view of the coaster laid on top of a surface.

FIG. 17 shows a side view 1704 of the coaster laid on top of a surface 1708. Objects 1712, 1716, and 1720 touch the surface and raise the coaster a distance 1724 above the surface. The coaster is evenly placed on the surface. A back of a base surface of the coaster does not touch the surface. Although the back surface does not rest on the surface, the objects are arranged such that the coaster will not be uneven and will lay flat.

Figure 18:
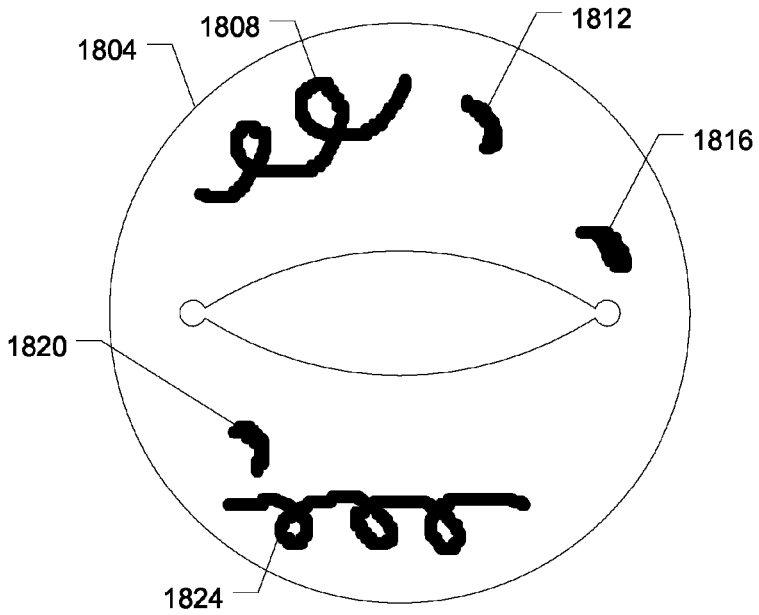
FIG. 18 shows a specific implementation of a multilayered silicone coaster having a base surface and confetti shapes on the base surface.

FIG. 18 shows a specific implementation of a multilayered silicone coaster having a base surface 1804 and confetti shapes 1808, 1812, 1816, 1820, 1820, and 1824 on the base surface.

Figure 19:
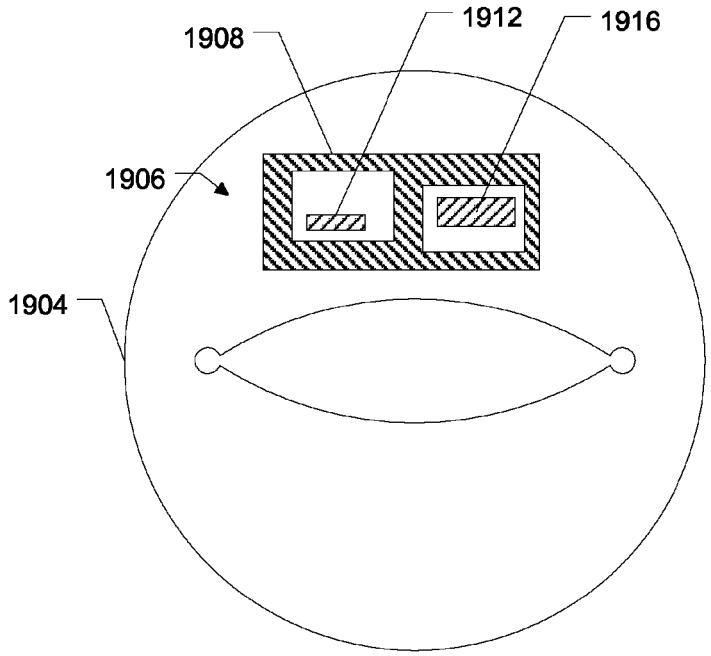
FIG. 19 shows a specific implementation of a multilayered silicone coaster having a base surface that includes an object.

FIG. 19 shows a specific implementation of a multilayered silicone coaster having a base surface 1904 that includes an object 1906. Object 1906 has a first layer feature 1908, a second layer feature 1912, and a third layer feature 1916. Second layer feature 1912 and third layer feature 1916 are two single layer features (similar to object 908). First layer feature 1908 has two openings or cutouts in which second layer feature 1912 and third layer feature 1916 are positioned within such that a portion of the base surface is visible. In other implementations, feature 1908 can have more than two openings, such as 3, 4, 5, 6, 7, 8, 9, or 10 or more. Further, within each opening, there can be multiple features or multiple layers (e.g., more than 1 layer such as 2, 3, 4, 5, or more layers). Although features 1908, 1912, and 1916 shown as rectangularly shaped items, it should be understood that these features can be of any shape as desired and as described above with respect to object 908.

Referring back to FIG. 4, of a perspective view 404 of a specific implementation of a coaster. The coaster has outer ridges 408 that outline the coaster. In an implementation, a height of the ridges is greater than a height of a front layer 412 of the coaster. In another implementation, a height of the ridges is substantially equal to a height of the front layer of the coaster. In another implementation, a height of the ridges is less than a height of the front layer of the coaster.

Figure 20:
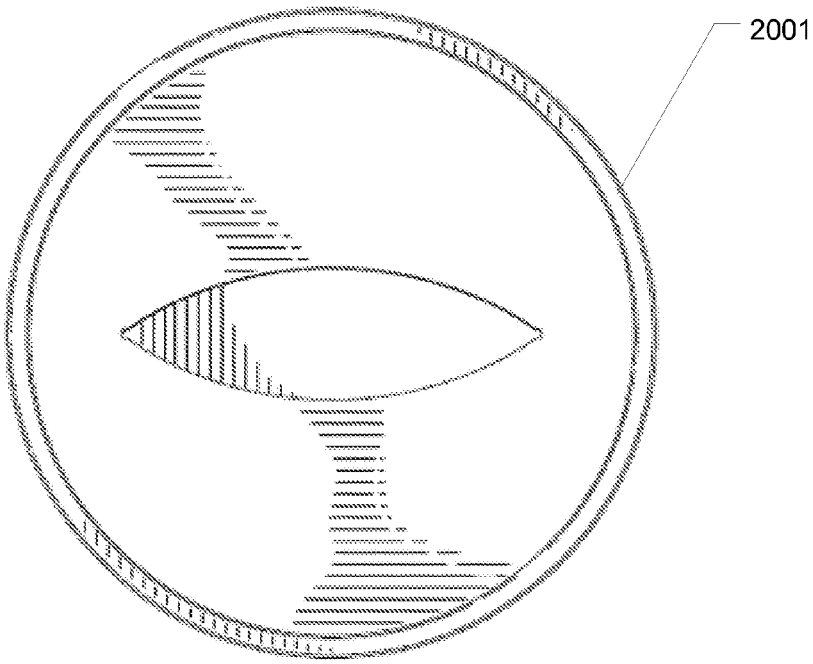
FIG. 20 shows a front view of a specific implementation of a coaster.

FIG. 20 shows a front view of a specific implementation of a coaster. This implementation of the coaster has a raised edge 2001.

Figure 21:
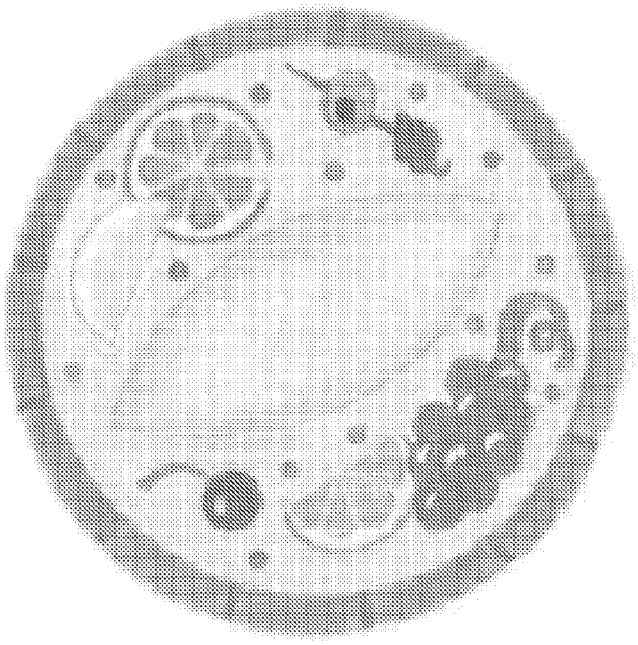
FIG. 21 shows a front view of a specific implementation of a coaster.

FIG. 21 shows a front view 2104 of a specific implementation of a coaster. The coaster has outer ridges 2108 that outline the coaster and have fruit illustrations.

Figure 22:
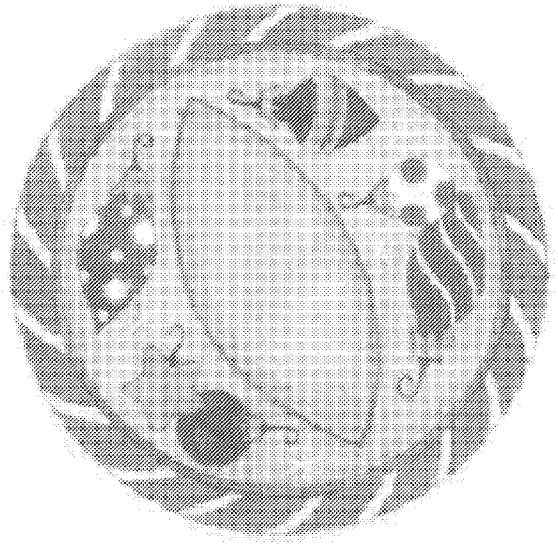
FIG. 22 shows a front view of a specific implementation of a coaster.

The coaster can be designed to have seasonal interpretations such as Halloween, Thanksgiving, Christmas, Hanukkah, Tet, Valentine's Day, Fourth of July, and others. The coaster can also be designed to have themed party designs such as a Luau, Mardi Gras, Cinco de Mayo, or other. FIG. 22 shows a front view 2204 of a specific implementation of a coaster. The coaster has a Christmas-themed illustration on it.

Figure 23:
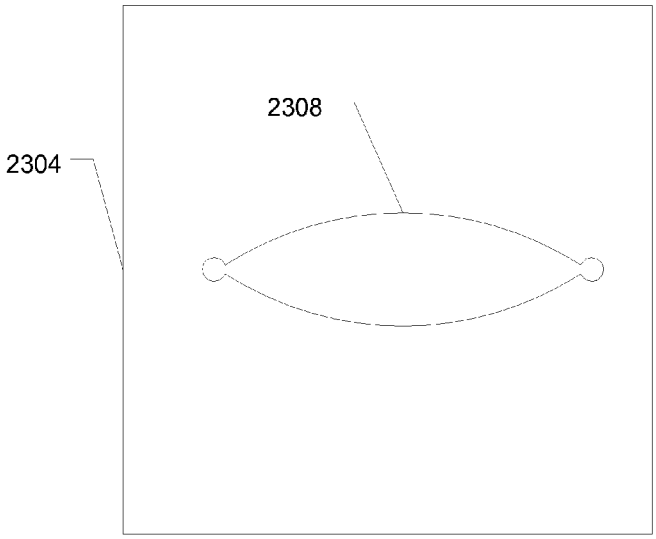
FIG. 23 shows a front view of a specific implementation of a coaster having a rectangular-shaped base.
Figure 24:
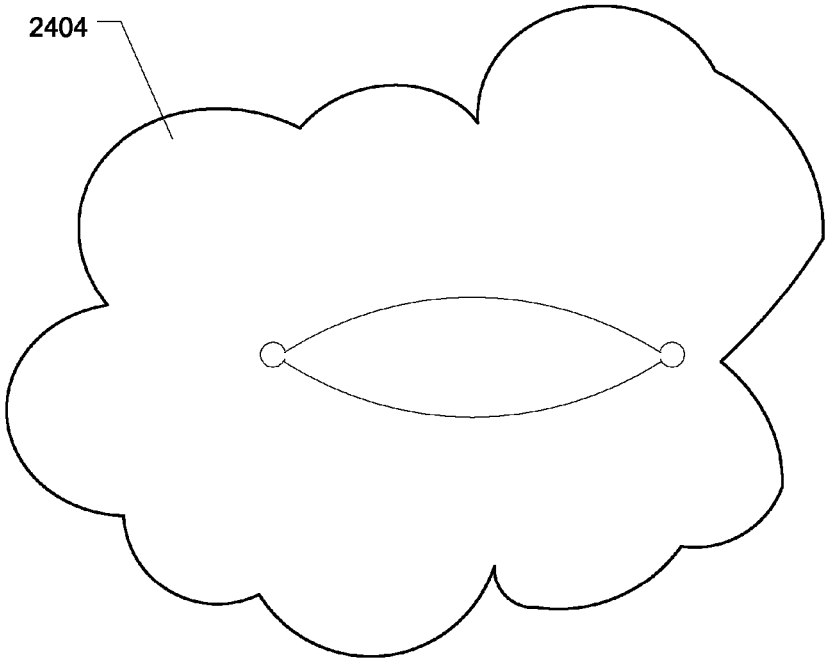
FIG. 24 shows a front view of a specific implementation of a coaster having a cloud-shaped base.

The coaster has been described as having a circular shape with a slit opening. The base of the coaster can be formed or molded to have any desirable shape. For example, in an implementation, a coaster has shape of an oval, ellipse, or others. FIG. 23 shows a front view of a specific implementation of a coaster having a rectangular-shaped base 2304. FIG. 24 shows a front view of a specific implementation of a coaster having a cloud-shaped base 2404. In another implementation, the coaster has a sunflower-shaped base or a different shape.

Figure 25:
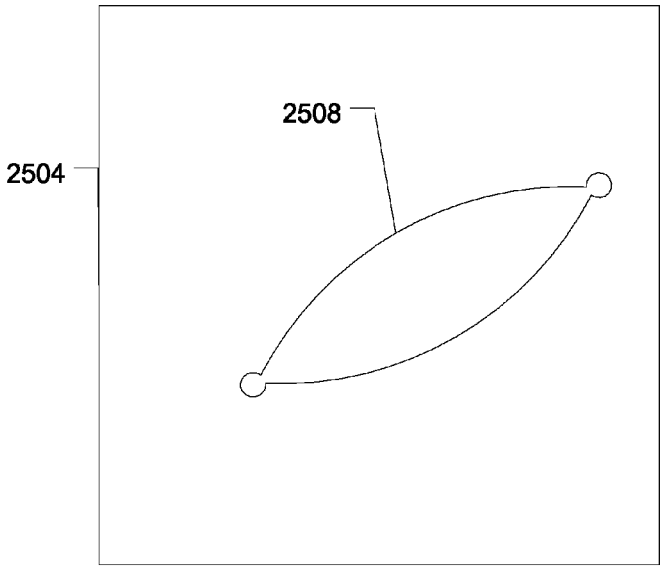
FIG. 25 shows a specific implementation of a coaster having a rectangular-shaped base and a slit opening located diagonally across the rectangular-shaped base.
Figure 26:
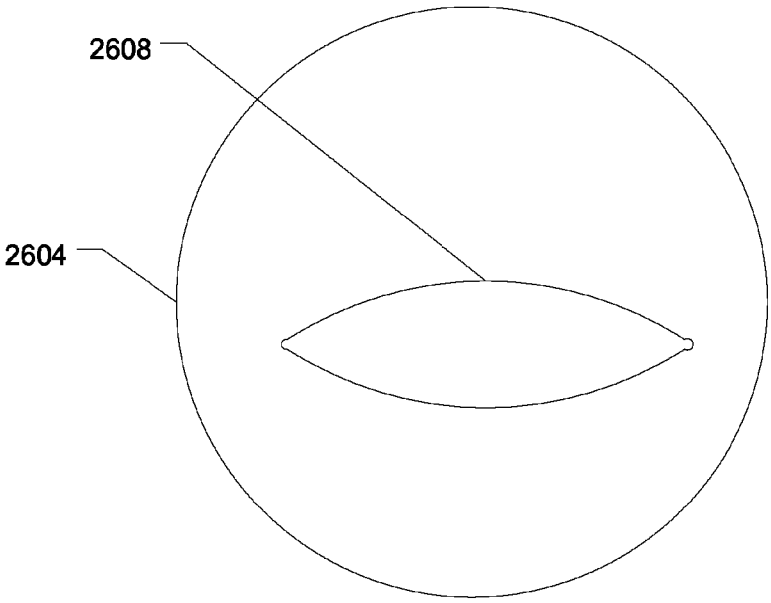
FIG. 26 shows a specific implementation of a coaster having a circular-shaped base and a slit opening.

Further, a slit opening can be located substantially anywhere on a side of the coaster. For example, FIG. 25 shows a specific implementation of a coaster having a rectangular-shaped base 2504 and a slit opening 2508 located diagonally across the rectangular-shaped base. FIG. 26 shows a specific implementation of a coaster having a circular-shaped base 2604 and a slit opening 2608 that is center of the base. In an implementation, the ratio of the height and length of the slit opening is approximately 1 to 2.

Figure 27:
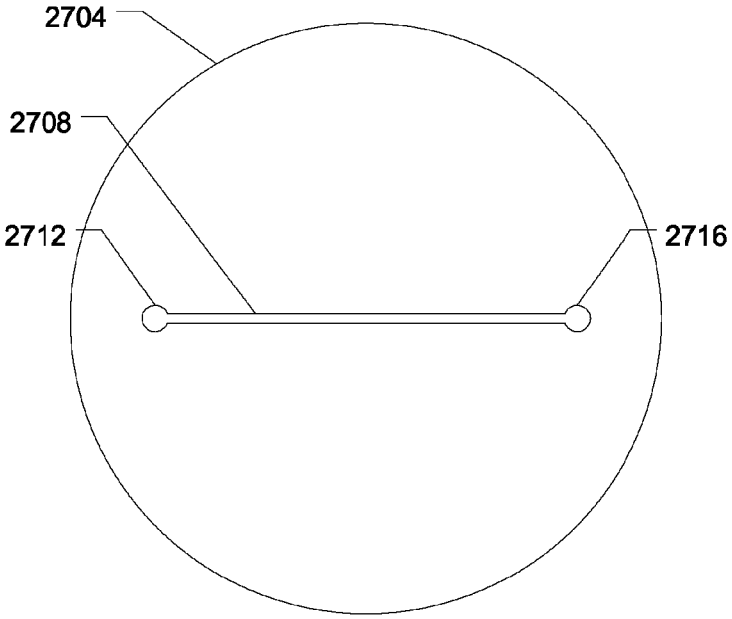
FIG. 27 shows a front view of a specific implementation of a coaster having a rectangular-shaped opening into which a base of a wine glass can be inserted.

Further, a slit opening can be different from that described above. FIG. 27 shows a front view of a specific implementation of a coaster having a rectangular-shaped opening 2708 into which a base of a wine glass can be inserted. The rectangular-shaped opening has a first end opening 2712 and a second end opening 2716.

Openings of the coaster may be different shapes and sizes. As described in greater detail elsewhere in this document, some openings may be a slit, rectangular, oval, hexagonal, circular, or other shapes. Some benefits of having different shapes and sizes of openings are that different openings affect how the coaster can be used. A tighter smaller opening (e.g., the slit type opening, or other smaller openings) will assist the coaster in staying attached to the base of the glass when it is used. A wider type opening (e.g., rectangular, or other) makes installing the coaster on the base of a glass easier. This allows the coaster to be made of less stretchy material (e.g., cloth, or a less stretchy silicone or other plastic blend) that still allows the coaster to stay on the base of the glass. Additionally, different shape openings may accommodate different shape bases for glasses. A square base fits better with a square type opening.

Figure 28:
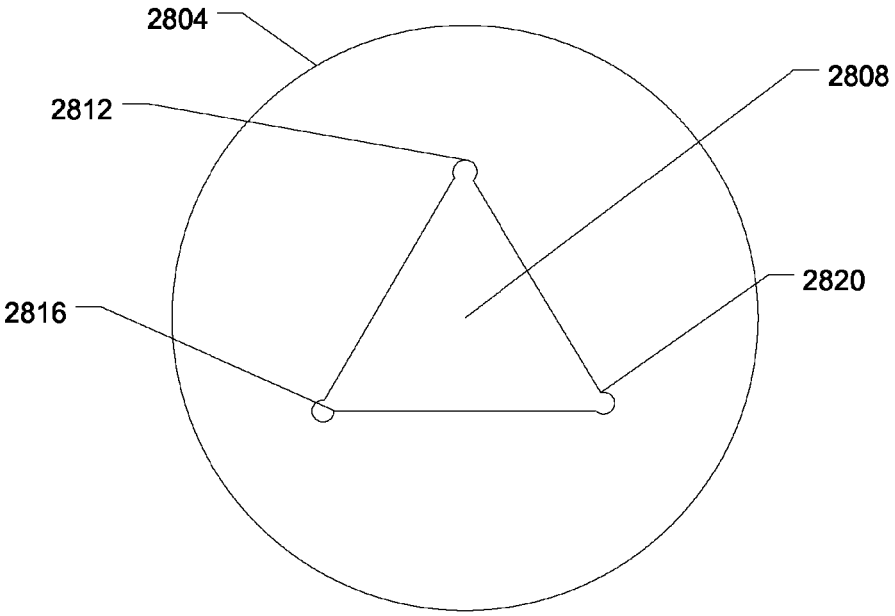
FIG. 28 shows a front view of a specific implementation of a coaster having a triangular-shaped opening into which a base of a wine glass can be inserted.

FIG. 28 shows a front view 2804 of a specific implementation of a coaster having a triangular-shaped opening 2808 into which a base of a wine glass can be inserted. The triangular-shaped opening has three end openings, a first end opening 2812, a second end opening 2816, and a third end opening 2820.

Figure 29:
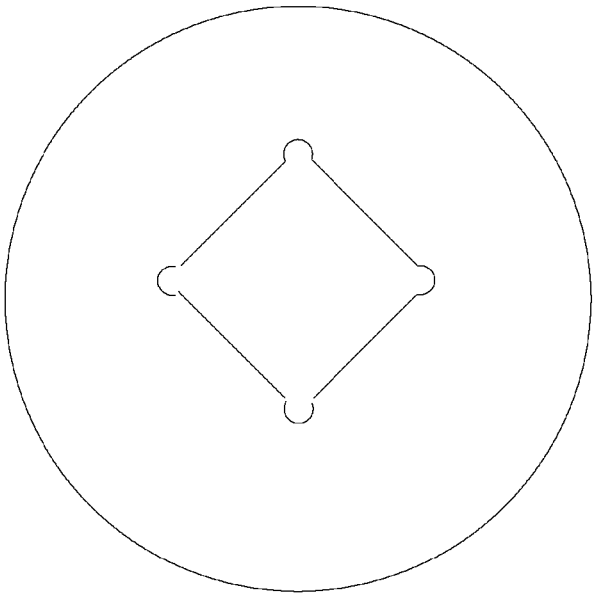
FIG. 29 shows a specific implementation of a coaster having a diamond-shaped opening into which a base of a wine glass can be inserted.

FIG. 29 shows a specific implementation of a coaster having a diamond-shaped opening into which a base of a wine glass can be inserted. The diamond-shaped opening has four end openings.

Figure 30:
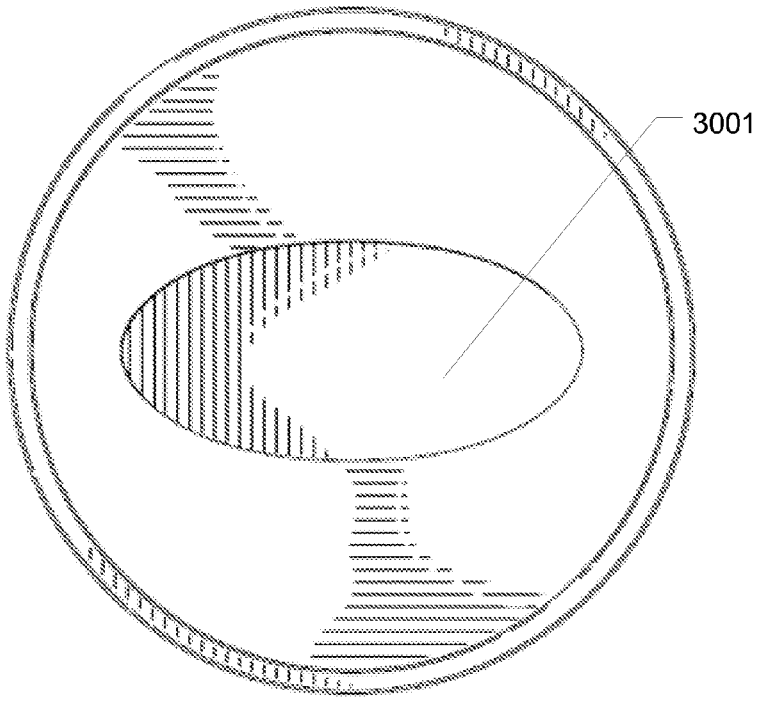
FIG. 30 shows a front view of a first specific implementation of a coaster with an oval opening.
Figure 31:
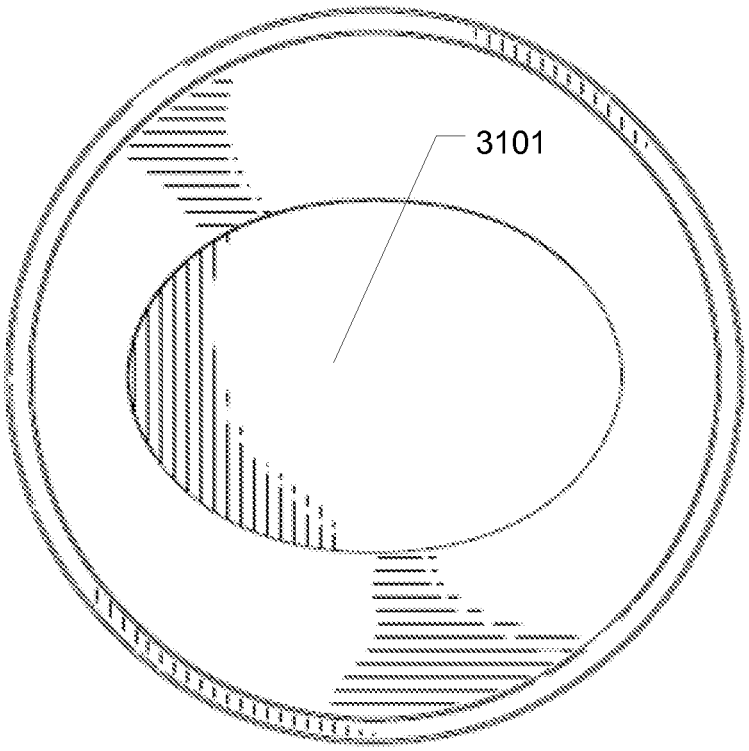
FIG. 31 shows a front view of a second specific implementation of a coaster with an oval opening.

FIG. 30 shows a front view of a first specific implementation of a coaster with an oval opening 3001. FIG. 31 shows a front view of a second specific implementation of a coaster with an oval opening 3101. When comparing openings 3001 and 3101, the oval opening 3101 is more elongated while the oval opening 3001 is more circular. This means that the height of opening 3101 is greater than the height of opening 3001. For example, the ratio of the height of the openings 3001 and 3101 is approximately 1 to 1.5, respectively. The ratio of the diameter of the coaster with the height of opening 3001 is approximately 3 to 1. The ratio of the diameter of the coaster with the height of opening 3101 is approximately 2 to 1.

Figure 32:
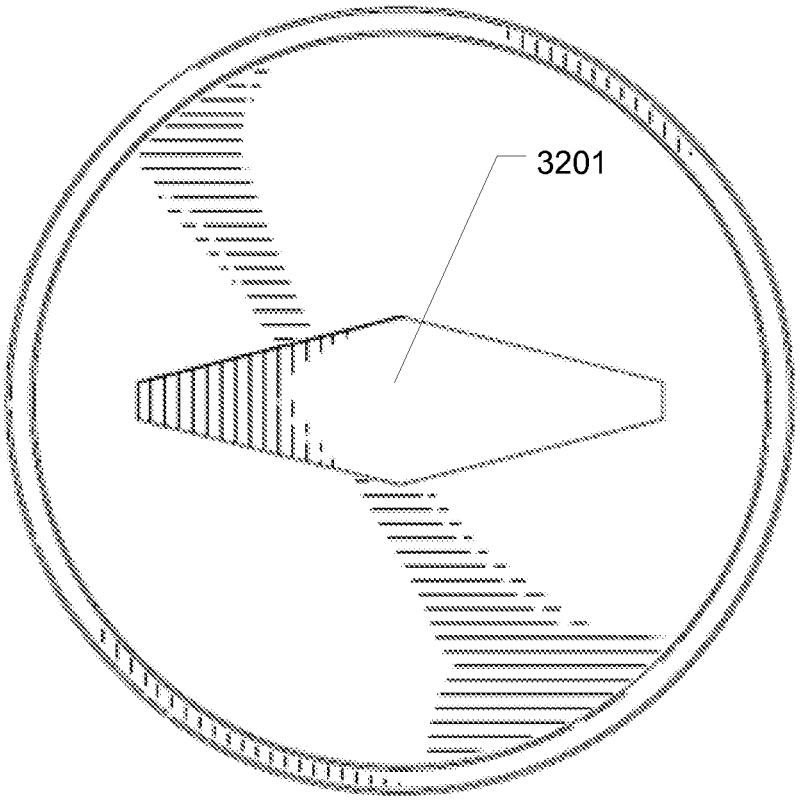
FIG. 32 shows a front view of a first specific implementation of a coaster with a hexagonal opening.
Figure 33:
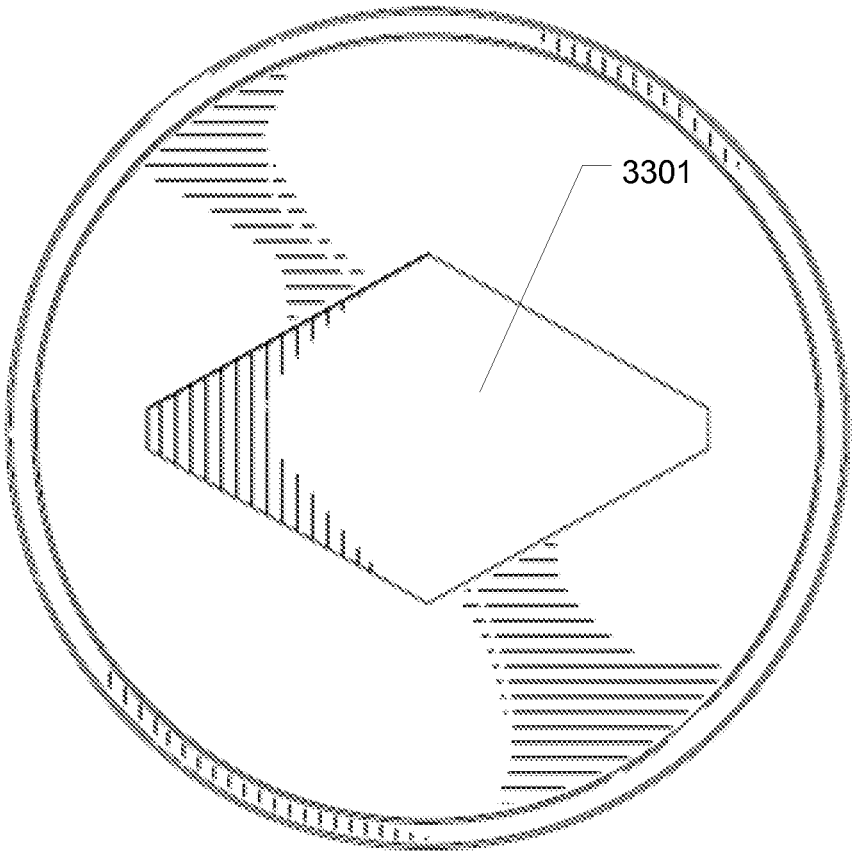
FIG. 33 shows a front view of a second specific implementation of a coaster with a hexagonal opening.
Figure 34:
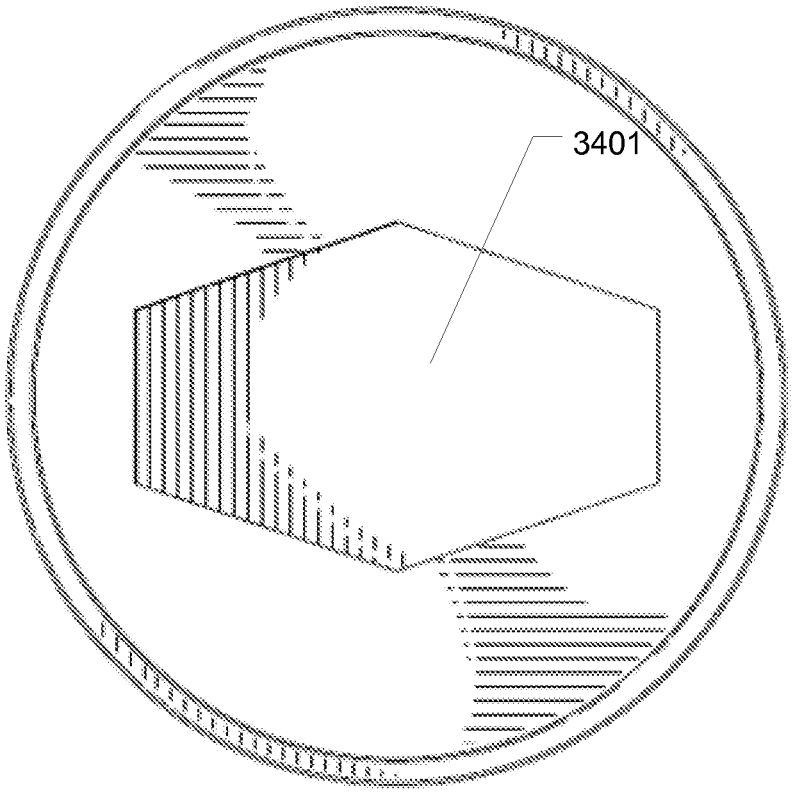
FIG. 34 shows a front view of a third specific implementation of a coaster with a hexagonal opening.

FIG. 32 shows a front view of a first specific implementation of a coaster with a hexagonal opening 3201. FIG. 33 shows a front view of a second specific implementation of a coaster with a hexagonal opening 3301. FIG. 34 shows a front view of a third specific implementation of a coaster with a hexagonal opening 3401. Each of the openings 3201, 3301, and 3401 increase in height while their lengths are approximately equal. Opposite sides of the hexagonal are also approximately the same length. The ratio of the diameter of the coaster with the height of opening 3201 is approximately 5 to 1. The ratio of the diameter of the coaster with the height of opening 3301 is approximately 2.4 to 1. The ratio of the diameter of the coaster with the height of opening 3401 is approximately 2.26 to 1.

The internal angles of the hexagonal openings can be divided into a first set of angles with the same angle measurement and a second set of angles with the same angle measurement, where the first set of angles are smaller than the second set of angles. There are four angles in the first set and two angles in the second set. For example, for opening 3201, the first set is approximately 105 degrees and the second set is approximately 150 degrees. For opening 3301, the first set is approximately 117.5 degrees and the second set is approximately 125 degrees. For opening 3401, the first set is approximately 110 degrees and the second set is approximately 140 degrees. In an implementation, end openings are present at some or all of the corners of a hexagonal opening.

Figure 35:
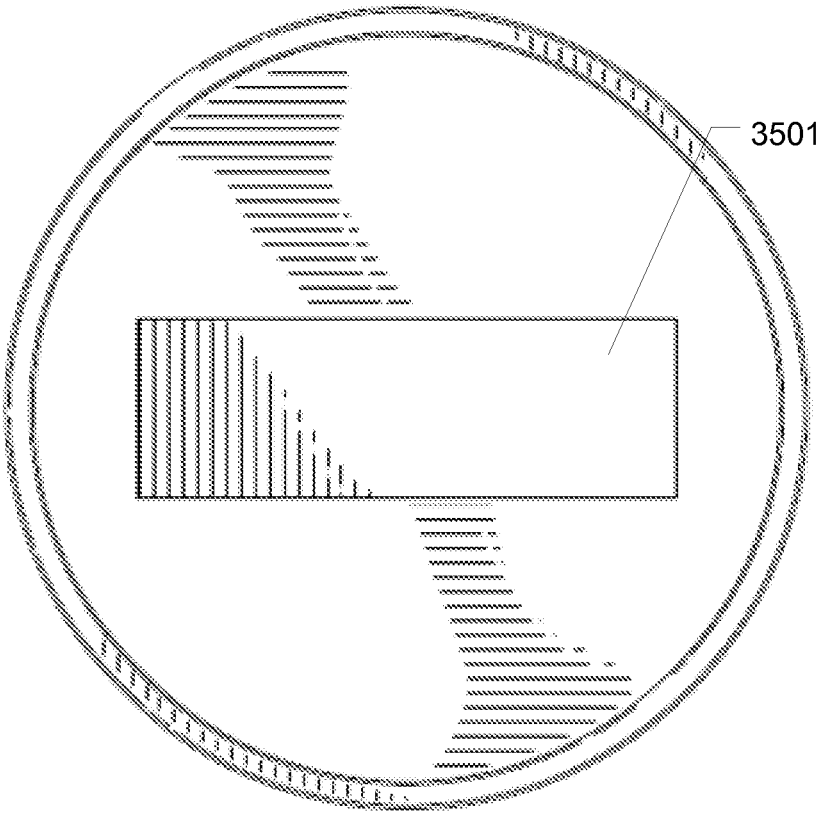
FIG. 35 shows a front view of a first specific implementation of a coaster with a rectangular opening.
Figure 36:
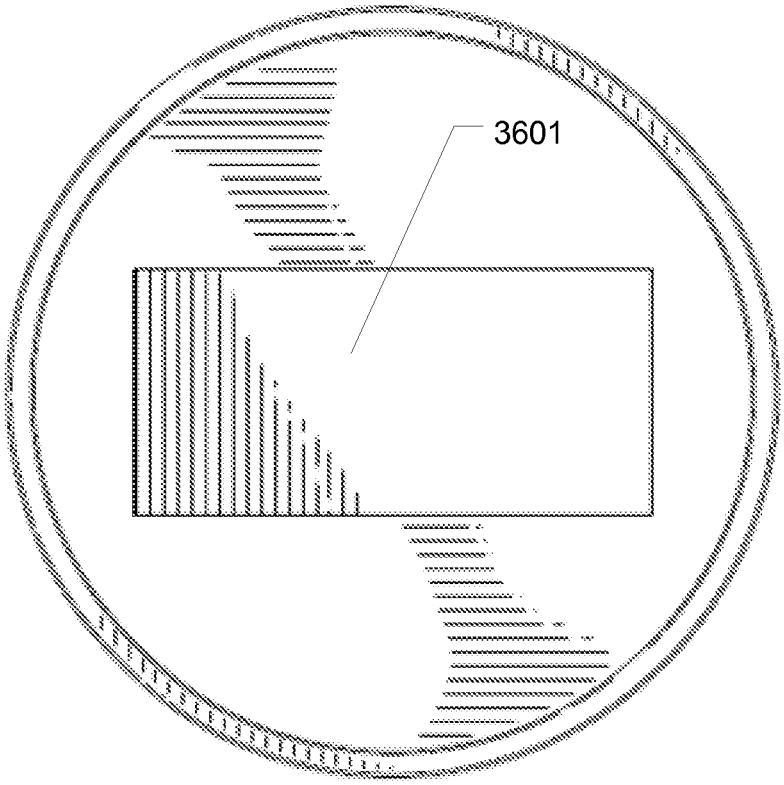
FIG. 36 shows a front view of a second specific implementation of a coaster with a rectangular opening.
Figure 37:
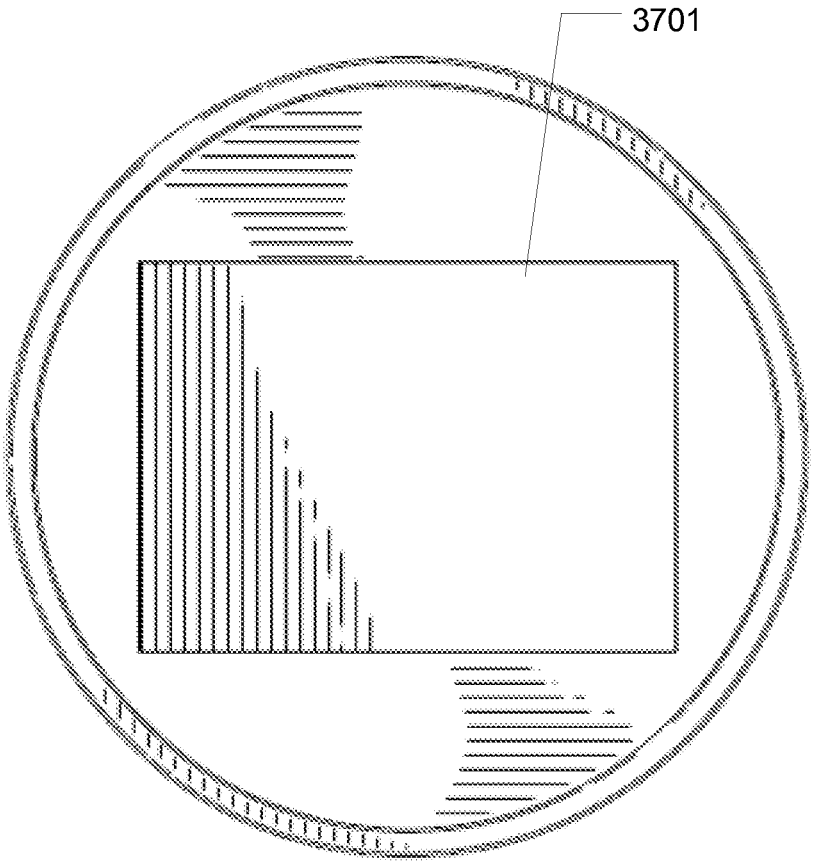
FIG. 37 shows a front view of a third specific implementation of a coaster with a rectangular opening.

FIG. 35 shows a front view of a first specific implementation of a coaster with a rectangular opening 3501. FIG. 36 shows a front view of a second specific implementation of a coaster with a rectangular opening 3601. FIG. 37 shows a front view of a third specific implementation of a coaster with a rectangular opening 3701. The lengths of the openings 3501, 3601, and 3701 can be approximately equal. The ratio of the height of the openings 3501, 3601, and 3701 are approximately 1 to 1.8 to 2.3, respectively. The ratio of the diameter of the coaster with the height of opening 3501 is approximately 4.3 to 1. The ratio of the diameter of the coaster with the height of opening 3601 is approximately 3 to 1. The ratio of the diameter of the coaster with the height of opening 3701 is approximately 2 to 1.

Figure 38:
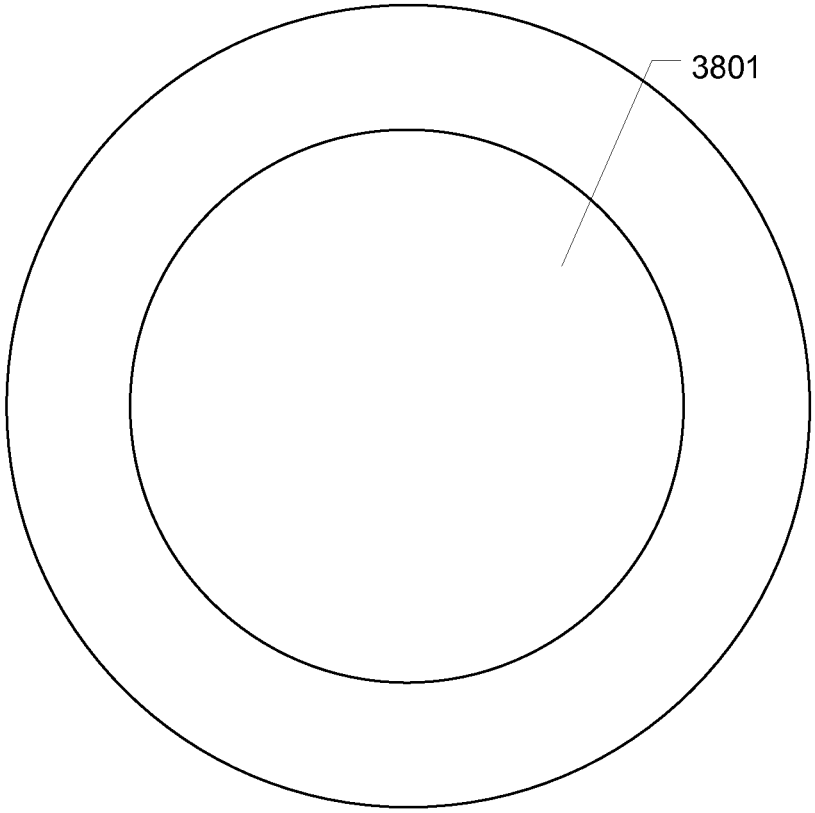
FIG. 38 shows a front view of a specific implementation of a coaster with a circular opening.

FIG. 38 shows a front view of a specific implementation of a coaster with a circular opening 3801.

Figure 39:
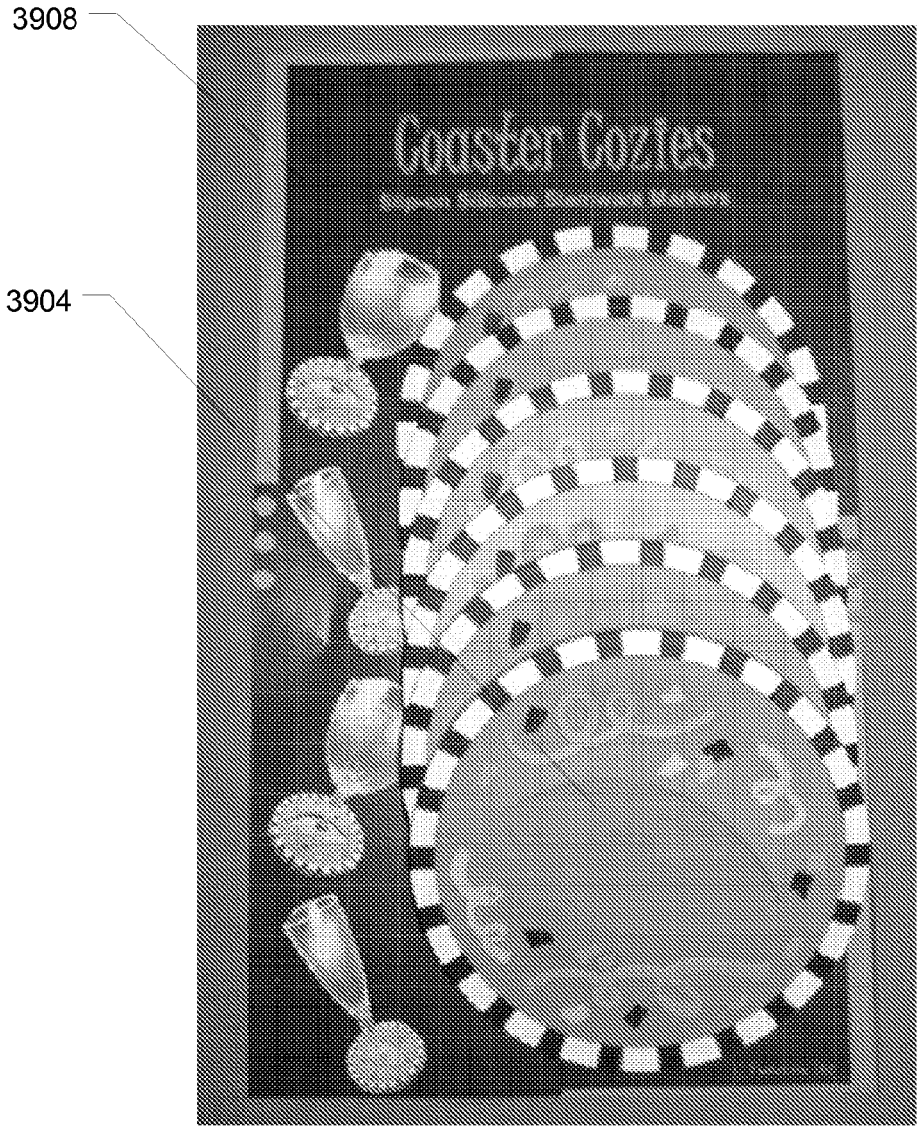
FIG. 39 shows a specific implementation of packaged coaster products.

The finished coaster product can be packaged. FIG. 39 shows a specific implementation of packaged coaster products. In this implementation, the package has six coasters 3904 and a card 3908. These coasters can be different colors, shades, or hues from each other in order to more easily allow a user to distinguish his or her coaster from another. Further, these coasters can have different ornamentations or designs to more easily allow a user to distinguish his or her coaster from another. The card can have different phrases to attract a consumer's eye. The card can be made of a rigid material, so that the coasters are kept in position while the packaged coaster is displayed. For example, the coasters can be arranged in an overlapping fashion, so that at least a portion of every coaster in the packaging is visible. In an implementation, a plastic shell covers the coasters and the plastic shell is glued to the card. In another implementation, the coasters are attached or glued to the backing directly. The glue can be a non-permanent glue, so that the coasters can be removed from the card without leaving any marks on the coasters.

A packaged coaster product can contain less or more than six coasters. For example, in another implementation, coasters are sold individually and a packaged product has one coaster. In various implementations, a packaged coaster product has 2, 3, 4, 5, 7, 8, or more coasters.

The packaged coaster product described can have more than or less than the components described. For example, in another implementation, a packaged coaster product does not have a card.

A specific process flow for making a coaster of the invention is presented below, but it should be understood that the invention is not limited to the specific flows and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application.

1. Join or attach a top piece and a bottom piece of silicone material. The top and bottom pieces are joined along edges of the top and bottom pieces. However, not the entire surface of the top and bottom pieces are joined. For example, at least a portion of the top and bottom pieces are not joined. This forms the sleeve or pocket for the coaster.

A shape of the coaster can be any shape. A base of the coaster can be any desired color by using a silicone colorant. Solid silicone typically melts at about 210 degrees Celsius (or a temperature above this).

2. Make an opening on the top piece of the silicone material. This is the slit opening into which a base of a wine glass can be inserted.

3. Make side openings that connect to the opening.

4. Liquid silicone is mixed with a colorant, which is also a silicone material. The silicone colorant will color the liquid to any desirable color. As described above, there may be multiple colors of liquid silicone used in a single coaster item. The liquid silicone can be the same or differently colored (or different shade) from the base silicone material. Liquid silicone typically melts at about 160 degrees Celsius (or a temperature above this), which is lower than the melting point of solid silicone.

5. Syringes are loaded with the colored liquid silicone. There can be multiple colors or hues of colored liquid silicone, each in a separate syringe. For example, if a three-color coaster is desired, there would be two syringes with two different colors of silicone. These would be differently colored from the base silicone. Depending on the intricacy of the patterning, there can be 3, 4, 5, 6, or 7 or more syringes of different colors used to create a single coaster item.

6. The colored liquid silicone is squeezed (or inlayed) and inserted in cavities of a mold (or a tooling set). The mold will have the patterning, lettering, or shapes that the manufacturer desires to have placed on the surface of the base. A size of each of the cavities can vary (e.g., to vary widths of the patterning). A depth of each of the cavities can vary (e.g., to vary heights of the patterning). Typically there will be one mold for the front side of the coaster and another mold for the back side.

In a specific implementation, the squeezing of the colored liquid silicone into the cavities of the mold is done by hand. However, in other implementations, the liquid silicone is inserted into the mold mechanically or using a machine (e.g., computer-controlled injection). Further, the mold is made of any material that has a higher melting temperature than the silicone such as a metal or high-temperature plastic.

7. After the liquid silicone is placed in the mold, the solid silicone base is layered into the mold on top of the decoration. In an implementation, to pattern the front and back sides, the silicone base is placed in the mold on top of a first mold (e.g., front side). Then while the first mold is held against the silicone base, these are flipped over and placed on a second mold (e.g., back side). In another implementation, the front and back sides are patterned at different times. For example, the front side is patterned first, and then the base side is patterned afterwards. This implementation, however, may be more time-consuming.

8. The mold with the solid and liquid silicone is compressed and heated to vulcanize the solid and liquid silicones together. Compressing and heating may be done in a single process step. In an implementation, compressing and heating are done simultaneously in a compressing machine. For example, a compressing machine can be a metal panel. The temperature in the compressing machine may vary as long as the temperature is high enough to vulcanize the solid and liquid silicones together. Or compressing and heating may be performed in separate steps.

In an implementation, in the compressing machine, the solid silicone is heated to a temperature of about 200 degrees Celsius (about 392 degrees Fahrenheit) for about 2 minutes, and the liquid silicone is heated to a temperature of about 160 degrees Celsius (about 320 degrees Fahrenheit) for about 2 minutes.

9. After vulcanization is complete, the finished coaster is allowed to cool and removed from the mold. In an implementation, air is used to cool the material. In another implementation, cooling is by water cooling and the cooling time is about 15 seconds. The finished coaster can be packaged for sale.

After step 9, as discussed above, the process can include further steps of using additional molds and liquid silicone layers that are applied on top of the already vulcanized liquid silicone. This is useful for creating perhaps even more intricate patterning on the coaster product.

Generally, the more intricate the patterning is, the more time it takes to make a coaster, thus increasing its cost. For example, a coaster with six stars will generally be more expensive to manufacture than a coaster with four stars. More time and material is needed to fill the two additional starts in the mold with liquid silicone. Also, any additional liquid silicone, mold, compression, and heating steps after step 9 would also increase the cost.

Another specific process flow for making the silicone coaster using an inlay method is presented below, but it should be understood that the invention is not limited to the specific flows and steps presented. Some of the steps in this method can be used in conjunction with the steps from the method discussed above.

1. A tooling set and color blending set is used. The tooling set is used to set the shape of the silicone coaster and the color blending set is used to change the silicone into a desired color.

2. A liquid silicone is inlaid into the tooling set. This liquid silicone can be colored by using the color blending set before it is inlaid. The tooling set has a hole that contains depressions (or ridges) that will form the design of the silicone coaster. For example, the words "Happy Birthday!" is formed by the ridges of the tooling set.

When the liquid silicone is inlaid into the tooling set, the level of liquid silicone does not extend beyond the design. This means that the liquid silicone is injected only into the ridges of the tooling kit.

3. The remainder of the hole of the tooling kit is filled with a solid silicone. Any silicone that does not fit into the hole is removed.

4. The tooling kit is inserted into a heat machine set at about 200 degrees Fahrenheit (or 93.3 degrees Celsius) for about 150 seconds.

5. The tooling kit is removed from the heat machine and allowed to cool.

This silicone rubber manufacturing technique allows for the creation of unique design features such as intricate multicolor and multilevel design detailing, vibrant true colors without the use of paint, and numerous shape and size options.

Using 100 percent silicone for the coaster has numerous benefits. Silicone is more reliable than other organic materials even under extreme conditions. It has tremendous resistance to temperature extremes from about 316 degrees Celsius (about 600 degrees Fahrenheit) to about −101 degrees Celsius (about −150 degrees Fahrenheit), retaining a far higher tensile strength and tear resistance than do many organic rubbers. It substantially resists the deteriorating effects of sunlight, ozone, rain water, and atmospheric gases which cause weathering. Silicone does not cause staining, corrosion, or deterioration like other materials. As a result, the silicone coaster is durable and can be left outside without fear of being damaged. This prevents designs on the body of the coaster from being damaged. Furthermore, it is water resistant and flame retardant.

Other advantages of using silicone are that it is odorless and tasteless. This prevents the coaster from having a bad smell when it is initially used. Silicone can be easily washed. For example, in an implementation, the coaster can be washed in a dishwasher safely. Further, silicone does not stain.

In an implementation, at least a portion of the silicone used is a food grade silicone. Food grade silicone is nontoxic, does not stain food, dishes, or cookware, and is safe for use with foods that are to be consumed by pets, humans, and animals. Food grade silicone can be used in coasters with compartments and cavities that will hold treats and food for pets. In an implementation, at least one of the liquid and solid is a food grade silicone.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A method for making a coaster comprising:

providing a first layer having a first shape, wherein the first layer comprises silicone;

providing a second layer having the first shape, wherein the second layer comprises silicone;

forming an opening having a second shape within an edge of the second layer to have a length greater than its width;

coupling the second layer on the first layer along edges of the first and second layers, thereby forming a pocket between the first and second layers and the pocket is accessible via the opening;

forming the first layer using a solid silicone;

forming the second layer using a solid silicone;

applying liquid silicone to a surface of the second layer, wherein the liquid silicone has a different color than the solid silicone of the second layer; and permitting insertion of a base of a stemware glass into the opening of the second shape, wherein the coaster is held to the base of the stemware glass by the pocket of the coaster.

2. The method of claim 1 comprising:

forming the second shape of the opening to be a different shape than the first shape.

3. The method of claim 1 comprising:

forming the first shape to be a circle; and forming the second shape of the opening to be a shape other than a circle.

4. The method of claim 1 comprising:

forming in the second layer the second shape having a first arc and a second arc, symmetrical to the first arc, and the first and second arc are joined at a first end by a first curved line and at a second end by a second curved line, symmetrical to the first curved line.

5. The method of claim 1 comprising:

selecting the liquid silicone having a different color than the solid silicone of the second layer.

6. The method of claim 1 comprising:

permitting insertion of a base of a stemware glass into the opening of the second shape, wherein coaster is held to the base of the stemware glass by the pocket of the coaster.

7. The method of claim 1 comprising:

forming a third shape of the pocket to be a circle having a diameter larger than the base of the stemware glass.

8. The method of claim 1 comprising:

forming the opening of the second layer to allow the first layer to be visible through the opening.

9. The method of claim 1 comprising:

forming the first shape to be circular and forming the second shape not be circular.

10. A method of making a silicone coaster comprising:

mixing liquid silicone with first silicone color paste to obtain a colored liquid silicone;

loading syringes with the colored liquid silicone;

inserting the colored liquid silicone in cavities of a mold according to a pattern;

heating to set the liquid silicone;

mixing solid silicone with second silicone color paste to obtain a first colored solid silicone;

layering the first colored solid silicone material into the mold on top of the liquid silicone;

vulcanizing the solid and liquid silicone together, wherein the vulcanizing comprises closing the mold;

cooling the solid and liquid silicone;

trimming a silicone flashing;

cutting an opening in the first solid silicone; and vulcanizing the first solid silicone with vulcanized liquid silicone onto a second solid silicone layer, thereby forming a pocket between the first and second layers and the pocket is accessible via the opening in the first solid silicone.

11. The method of claim 10 comprising:

selecting the first silicone color paste to be a different color from the second silicone color paste.

12. The method of claim 10 comprising:

forming the second solid silicone layer to not have an opening.

13. A kit for a collection of coasters comprising:

a first silicone coaster of the collection comprising two silicone layers joined around along an edging of the layers, wherein between the layers is an unjoined region forming a pocket, which is accessible through an opening formed in an upper silicone layer of the two silicone layers, the opening having a length greater than its width, and a first colored ornamentation is applied to the upper layer; and a second silicone coaster of the collection comprising two silicone layers joined around along an edging of the layers, wherein between the layers is an unjoined region forming a pocket, which is accessible through an opening formed in an upper silicone layer of the two silicone layers, the opening having a length greater than its width, and a second colored ornamentation is applied to the upper layer, where the second colored ornamentation is different from the first colored ornamentation.

14. The kit of claim 13 wherein a shape of the opening of the first silicone coaster is the same as the opening of the second silicone coaster.

15. The kit of claim 13 wherein shapes of the openings of first and second silicone coasters are not circular.

16. The kit of claim 13 wherein the first colored ornamentation comprises different lettering than the second colored ornamentation.

17. The kit of claim 13 wherein for the first silicone coaster, the two silicone layers are formed from solid silicone and the first colored ornamentation is formed from liquid silicone.

18. The kit of claim 13 wherein the opening of the first silicone coaster comprises a first arc and a second arc, symmetrical to the first arc, and the first and second arc are joined at a first end by a first curved line and at a second end by a second curved line, symmetrical to the first curved line.

* * * * *